US007180981B2

(12) United States Patent
Wang

(10) Patent No.: US 7,180,981 B2
(45) Date of Patent: Feb. 20, 2007

(54) HIGH QUANTUM ENERGY EFFICIENCY X-RAY TUBE AND TARGETS

(75) Inventor: Chia-Gee Wang, New York, NY (US)

(73) Assignee: Nanodynamics-88, Inc., New York, NY (US)

( * ) Notice: Subject to any disclaimer, the term of this patent is extended or adjusted under 35 U.S.C. 154(b) by 0 days.

(21) Appl. No.: 10/960,445

(22) Filed: Oct. 7, 2004

(65) Prior Publication Data

US 2005/0123097 A1 Jun. 9, 2005

Related U.S. Application Data

(63) Continuation of application No. PCT/US03/09889, filed on Apr. 2, 2003.

(30) Foreign Application Priority Data

Apr. 8, 2002 (JP) ..... 2002-105507

(51) Int. Cl.
*H01J 35/08* (2006.01)

(52) U.S. Cl. ..... 378/124; 378/119; 378/121; 378/137; 378/143

(58) Field of Classification Search ..... 378/124, 378/143, 144, 119, 121, 137
See application file for complete search history.

(56) References Cited

U.S. PATENT DOCUMENTS 2,942,126 A 6/1960 Silbermann
3,171,030 A 2/1965 Foster et al.
3,176,137 A 3/1965 Hofmann et al.
3,239,706 A 3/1966 Farrell et al.
3,517,195 A 6/1970 Leavitt
3,584,219 A 6/1971 Herglotz et al.
3,610,984 A 10/1971 Seki et al.
3,867,637 A 2/1975 Braum et al.
3,894,239 A 7/1975 Braum
3,949,229 A 4/1976 Albert
3,961,173 A 6/1976 Perry et al.
3,963,922 A * 6/1976 Zulliger et al. ..... 378/45
3,983,397 A 9/1976 Albert
4,007,375 A * 2/1977 Albert ..... 378/113
4,017,757 A 4/1977 De Cou, Jr.
4,032,787 A 6/1977 Albert
4,034,251 A 7/1977 Haas
4,048,496 A 9/1977 Albert
4,057,745 A 11/1977 Albert (Continued)

*Primary Examiner*—Courtney Thomas
*Assistant Examiner*—Jurie Yun
(74) *Attorney, Agent, or Firm*—Ladas and Parry LLP

(57) ABSTRACT

The invention relates to targets for an X-ray transmission tube (9); to a high efficiency, high excitation energy X-ray transmission tube; to combinations of the targets and high efficiency X-ray transmission tubes; and applications for utilizing such X-ray tubes. The target comprises two or more different thin foils (1) or at least two foils of the same material but different foil thickness on separate areas of a substantially planar substrate which is substantially transparent to X-rays. The target may also comprise at least two different foils (2, 3) layered sequentially one of the other, wherein X-rays are produced when an electron beam impinges the foil closest to the source fo the electron beam; wherein the energy of the electron beam is selectively changed to produce X-rays of a least one preselected energy characteristic of at least one of the foils.

27 Claims, 27 Drawing Sheets

U.S. PATENT DOCUMENTS

| | | | | |
|---|---|---|---|---|
| 4,104,526 | A | | 8/1978 | Albert |
| 4,109,058 | A | | 8/1978 | Love et al. |
| 4,144,457 | A | | 3/1979 | Albert |
| 4,149,076 | A | | 4/1979 | Albert |
| 4,159,437 | A | | 6/1979 | Sahores |
| 4,196,351 | A | | 4/1980 | Albert |
| 4,259,582 | A | | 3/1981 | Albert |
| 4,259,583 | A | | 3/1981 | Albert |
| 4,260,885 | A | | 4/1981 | Albert |
| 4,287,420 | A | | 9/1981 | Yamamura et al. |
| 4,288,697 | A | | 9/1981 | Albert |
| 4,321,473 | A | | 3/1982 | Albert |
| 4,323,779 | A | | 4/1982 | Albert |
| 4,335,327 | A | | 6/1982 | Waugh et al. |
| 4,344,013 | A | | 8/1982 | Ledley |
| 4,400,824 | A | | 8/1983 | Shidara |
| 4,422,399 | A | | 12/1983 | Morgan |
| 4,465,540 | A | | 8/1984 | Albert |
| 4,573,186 | A | | 2/1986 | Reinhold |
| 4,583,243 | A | | 4/1986 | Diemer et al. |
| 4,599,741 | A | | 7/1986 | Wittry |
| 4,622,687 | A | | 11/1986 | Whitaker et al. |
| 4,622,688 | A | | 11/1986 | Diemer et al. |
| 4,646,338 | A | | 2/1987 | Skillicorn |
| 4,694,480 | A | | 9/1987 | Skillicorn |
| 4,701,941 | A | | 10/1987 | Szirmai et al. |
| 4,723,262 | A | | 2/1988 | Noda et al. |
| 4,730,350 | A | | 3/1988 | Albert |
| 4,763,344 | A | * | 8/1988 | Piestrup ..... 378/119 |
| 4,793,358 | A | | 12/1988 | Kimura et al. |
| 4,800,581 | A | | 1/1989 | Kujirai et al. |
| 4,852,135 | A | | 7/1989 | Anisovich et al. |
| 4,870,671 | A | | 9/1989 | Hershyn |
| 4,876,705 | A | | 10/1989 | DeLair et al. |
| 4,894,852 | A | | 1/1990 | Das Gupta |
| 4,953,190 | A | | 8/1990 | Kukoleck et al. |
| 4,953,191 | A | | 8/1990 | Smither et al. |
| 4,964,148 | A | | 10/1990 | Klostermann et al. |
| 4,969,173 | A | | 11/1990 | Valkonet |
| 4,969,175 | A | | 11/1990 | Nelson et al. |
| 4,979,199 | A | | 12/1990 | Cueman et al. |
| 5,007,074 | A | | 4/1991 | Furbee et al. |
| RE33,634 | E | | 7/1991 | Yanaki |
| 5,044,001 | A | | 8/1991 | Wang |
| 5,051,600 | A | | 9/1991 | Schuetz et al. |
| 5,056,126 | A | | 10/1991 | Klostermann et al. |
| 5,060,254 | A | | 10/1991 | de Fraguier et al. |
| 5,077,771 | A | | 12/1991 | Skillicorn et al. |
| 5,077,777 | A | | 12/1991 | Daly |
| 5,105,456 | A | | 4/1992 | Rand et al. |
| 5,130,374 | A | | 7/1992 | Cozens et al. |
| 5,138,645 | A | | 8/1992 | Penato et al. |
| 5,157,704 | A | | 10/1992 | Harding |
| 5,159,629 | A | | 10/1992 | Double et al. |
| 5,164,975 | A | | 11/1992 | Steinmeyer |
| 5,173,612 | A | | 12/1992 | Imai et al. |
| 5,173,931 | A | | 12/1992 | Pond |
| 5,184,008 | A | | 2/1993 | Saito et al. |
| 5,185,774 | A | | 2/1993 | Klostermann |
| 5,199,058 | A | | 3/1993 | Tani et al. |
| 5,199,059 | A | | 3/1993 | Hohenauer |
| 5,200,984 | A | | 4/1993 | Laeuffer |
| 5,206,895 | A | | 4/1993 | Danos |
| 5,222,116 | A | | 6/1993 | Eloff et al. |
| 5,226,067 | A | | 7/1993 | Allred et al. |
| 5,237,598 | A | | 8/1993 | Albert |
| 5,259,014 | A | | 11/1993 | Brettschneider |
| 5,260,983 | A | | 11/1993 | Ono et al. |
| 5,264,801 | A | | 11/1993 | De Cou, Jr. et al. |
| 5,267,296 | A | | 11/1993 | Albert |
| 5,298,754 | A | | 3/1994 | Anderson et al. |
| 5,303,281 | A | | 4/1994 | Koller et al. |
| 5,345,493 | A | | 9/1994 | D'Achard Van Enschut et al. |
| 5,347,571 | A | | 9/1994 | Furbee et al. |
| 5,375,158 | A | | 12/1994 | Logan |
| 5,414,748 | A | | 5/1995 | Upadhya |
| 5,420,906 | A | | 5/1995 | Smit et al. |
| 5,422,926 | A | | 6/1995 | Smith et al. |
| 5,438,605 | A | | 8/1995 | Burke et al. |
| 5,463,268 | A | | 10/1995 | Schroeder |
| 5,469,490 | A | | 11/1995 | Golden et al. |
| 5,490,196 | A | | 2/1996 | Rudich et al. |
| 5,490,197 | A | | 2/1996 | Albert et al. |
| 5,494,849 | A | | 2/1996 | Iyer et al. |
| 5,497,008 | A | | 3/1996 | Kumakhov |
| 5,498,185 | A | | 3/1996 | Knudsen et al. |
| 5,509,045 | A | | 4/1996 | Kautz |
| 5,511,104 | A | | 4/1996 | Mueller et al. |
| 5,511,105 | A | | 4/1996 | Knott |
| 5,519,092 | A | | 5/1996 | Blackborow |
| 5,528,657 | A | | 6/1996 | Vonk |
| 5,528,658 | A | | 6/1996 | Hell |
| 5,550,378 | A | | 8/1996 | Skillicorn et al. |
| 5,563,923 | A | | 10/1996 | Okada et al. |
| 5,576,549 | A | | 11/1996 | Hell et al. |
| 5,585,644 | A | | 12/1996 | Van Der Borst |
| 5,596,622 | A | | 1/1997 | Peralta et al. |
| 5,610,967 | A | | 3/1997 | Moorman et al. |
| 5,621,781 | A | | 4/1997 | Blake et al. |
| 5,627,871 | A | * | 5/1997 | Wang ..... 378/121 |
| 5,629,970 | A | | 5/1997 | Woodruff et al. |
| 5,633,907 | A | | 5/1997 | Gravelle et al. |
| 5,644,612 | A | | 7/1997 | Moorman et al. |
| 5,651,043 | A | | 7/1997 | Tsuyuki et al. |
| 5,651,047 | A | | 7/1997 | Moorman et al. |
| 5,668,850 | A | | 9/1997 | Abdel-Malek |
| 5,682,412 | A | | 10/1997 | Skillicorn et al. |
| 5,693,363 | A | | 12/1997 | Kuroda et al. |
| 5,696,807 | A | | 12/1997 | Hsieh |
| 5,696,808 | A | | 12/1997 | Lenz |
| 5,699,401 | A | | 12/1997 | Jackson et al. |
| 5,703,924 | A | | 12/1997 | Hell et al. |
| 5,729,584 | A | | 3/1998 | Moorman et al. |
| 5,732,123 | A | | 3/1998 | Peralta et al. |
| 5,733,162 | A | | 3/1998 | Benz et al. |
| 5,734,692 | A | | 3/1998 | Seki |
| 5,734,915 | A | | 3/1998 | Roewer |
| 5,742,662 | A | | 4/1998 | Kuhn et al. |
| 5,745,548 | A | | 4/1998 | Dobbs et al. |
| 5,751,784 | A | | 5/1998 | Enck |
| 5,751,785 | A | | 5/1998 | Moorman et al. |
| 5,754,623 | A | | 5/1998 | Seki |
| 5,768,338 | A | | 6/1998 | Kuroda et al. |
| 5,781,610 | A | | 7/1998 | Miles |
| 5,808,306 | A | | 9/1998 | Skillicorn et al. |
| 5,812,632 | A | | 9/1998 | Schardt et al. |
| 5,822,395 | A | | 10/1998 | Schardt et al. |
| 5,825,848 | A | | 10/1998 | Virshup et al. |
| 5,828,727 | A | | 10/1998 | Schild |
| 5,835,561 | A | | 11/1998 | Moorman et al. |
| 5,838,761 | A | | 11/1998 | Behner et al. |
| 5,844,963 | A | | 12/1998 | Koller et al. |
| 5,857,008 | A | | 1/1999 | Reinhold |
| 5,859,893 | A | | 1/1999 | Moorman et al. |
| 5,898,755 | A | | 4/1999 | Meusel et al. |
| 5,907,595 | A | | 5/1999 | Sommerer |
| 5,910,974 | A | | 6/1999 | Kuhn et al. |
| 5,984,097 | A | | 11/1999 | Salasoo |
| 5,987,096 | A | | 11/1999 | Van Der Borst et al. |
| 5,995,585 | A | | 11/1999 | Salasoo |
| 6,002,745 | A | | 12/1999 | Miller et al. |
| 6,005,918 | A | | 12/1999 | Harris et al. |
| 6,015,325 | A | | 1/2000 | Inazuru et al. |
| 6,044,130 | A | | 3/2000 | Inazura et al. |

6,052,431 A 4/2000 Onoguchi et al.
6,052,433 A 4/2000 Chao
6,052,434 A 4/2000 Toth et al.
6,055,294 A 4/2000 Foerst et al.
6,060,713 A 5/2000 Skillicorn et al.
6,064,718 A 5/2000 Holland et al.
6,074,092 A 6/2000 Andrews
6,075,839 A 6/2000 Treseder
6,091,799 A 7/2000 Schmidt
6,091,800 A 7/2000 Van Andel et al.
6,097,789 A 8/2000 Mueller
6,111,933 A 8/2000 Schaaf et al.
6,111,934 A 8/2000 Foerst et al.
6,118,852 A 9/2000 Rogers et al.
6,118,853 A 9/2000 Hansen et al.
6,125,169 A 9/2000 Wandke et al.
6,128,367 A 10/2000 Foerst et al.
6,141,400 A 10/2000 Schardt et al.
6,151,384 A 11/2000 Reed et al.
6,157,702 A 12/2000 Reznikov et al.
6,164,820 A 12/2000 Hell et al.
6,173,996 B1 1/2001 Derakhsan et al.
6,175,612 B1 1/2001 Sato
6,175,614 B1 1/2001 Jensen et al.
6,178,226 B1 1/2001 Hell et al.
6,181,765 B1 1/2001 Sribar et al.
6,181,771 B1 1/2001 Hell et al.
6,185,276 B1 2/2001 Eastman
6,185,277 B1 2/2001 Harding
6,193,415 B1 2/2001 Kadowaki et al.
6,195,411 B1 2/2001 Dinsmore
6,198,802 B1 3/2001 Elliott et al.
6,204,211 B1 3/2001 Ohara et al.
6,205,200 B1 3/2001 Boyer et al.
6,229,876 B1 5/2001 Enck et al.
6,234,671 B1 5/2001 Solomon et al.
6,236,713 B1 5/2001 True et al.
6,252,936 B1 6/2001 Smit et al.
6,282,263 B1 8/2001 Arndt et al.
6,320,936 B1 11/2001 Holland, Sr. et al.
6,333,966 B1 12/2001 Schoen
6,333,968 B1 12/2001 Whitlock et al.
6,351,520 B1 2/2002 Inazaru
6,356,619 B1 3/2002 Nagy et al.
6,359,962 B1 3/2002 Yagi
6,364,528 B1 4/2002 Rossiger
6,373,922 B1 4/2002 Dalpe et al.
6,421,409 B1 7/2002 Paulus et al.
6,434,207 B1 8/2002 Mizumachi et al.
6,438,207 B1 8/2002 Chidester et al.
6,463,123 B1 * 10/2002 Korenev ..... 378/69
6,487,274 B2 * 11/2002 Bertsche ..... 378/143
6,504,901 B1 1/2003 Loxley et al.
6,560,313 B1 5/2003 Handing et al.
6,649,914 B1 11/2003 Moorman et al.
6,665,364 B2 12/2003 Mizumachi et al.
6,690,765 B1 2/2004 Miller

* cited by examiner

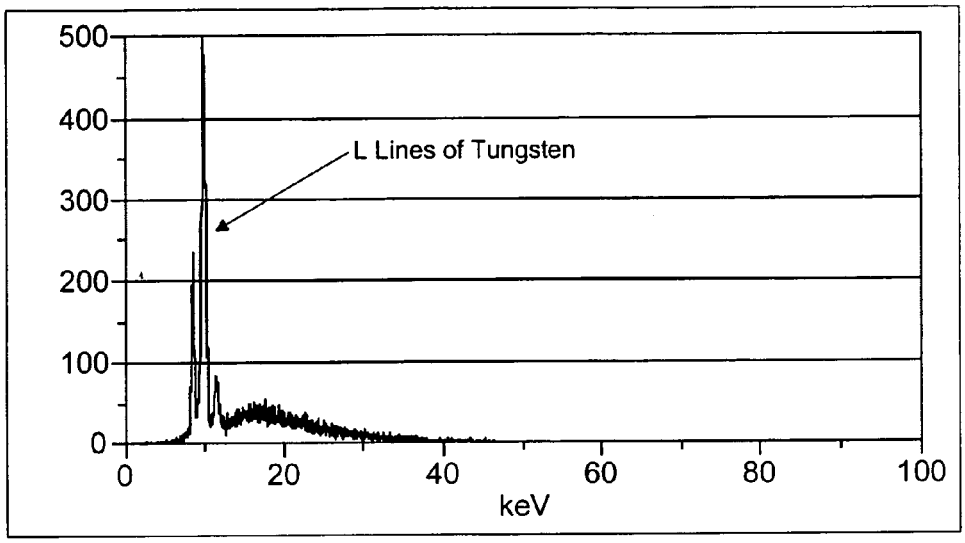
Figure 14 A. 5 micron tungsten target, 50 kV
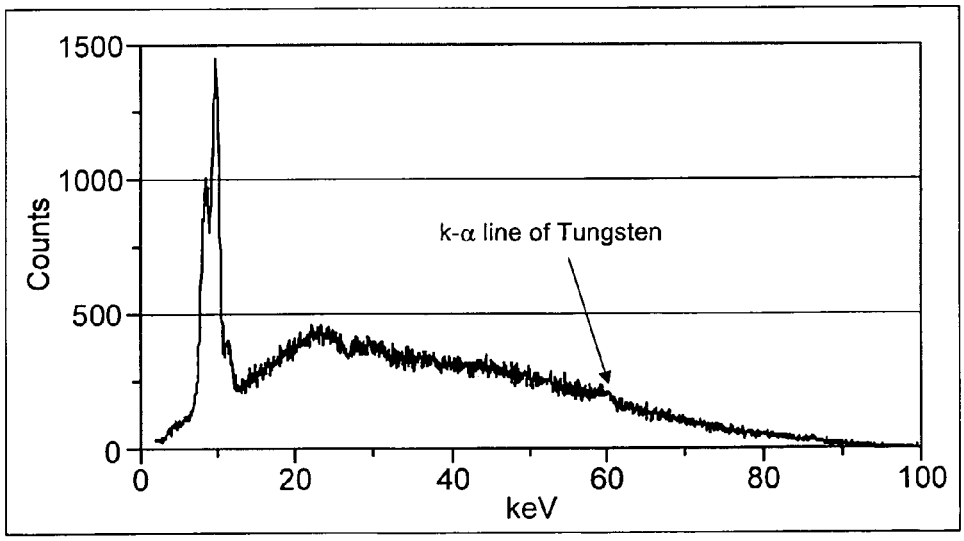
Figure 14 B. 5 micron tungsten target, 100 kV

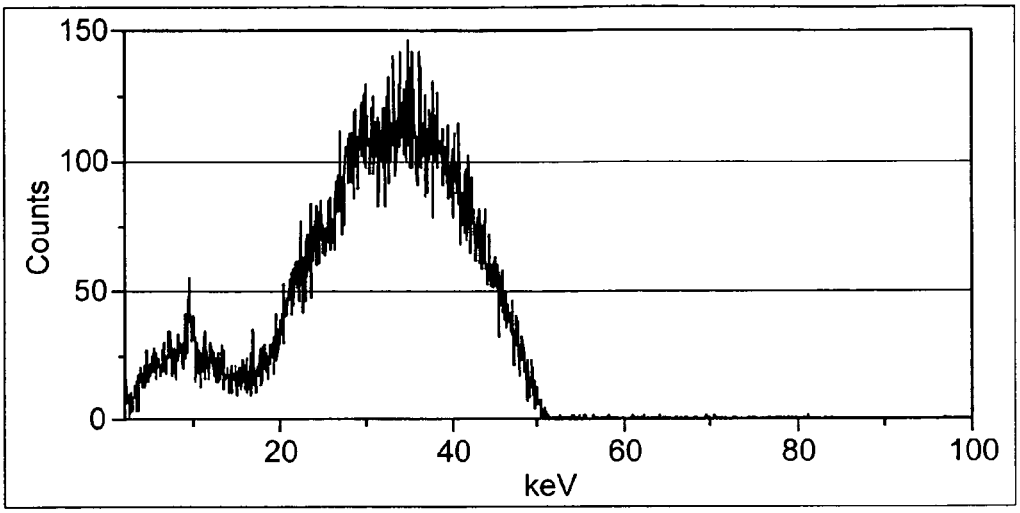
Figure 14 C. 25 micron tungsten target, 50 kV
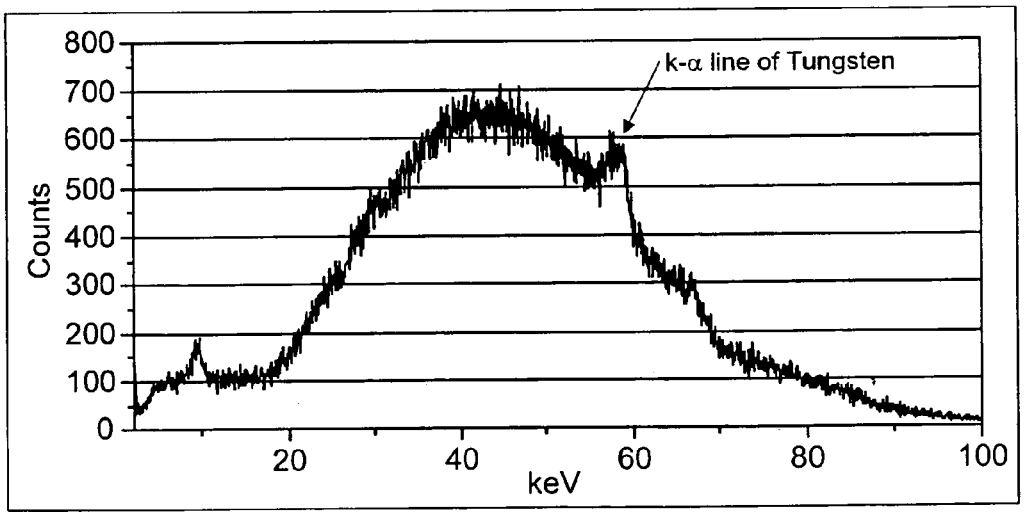
Figure 14 D. 25 micron tungsten target, 100 kV

HIGH QUANTUM ENERGY EFFICIENCY X-RAY TUBE AND TARGETS

This is a continuation of copending International Application PCT/US03/09889 filed on Apr. 2, 2003, which designated the U.S., claims the benefits thereof and incorporates the same by reference.

The invention relates to targets for an X-ray transmission tube; to a high efficiency, high excitation energy X-ray transmission tube; to a high efficiency, low excitation energy X-ray transmission tube; to combinations of the targets and high efficency X-ray transmission tubes; and applications for utilizing such x-ray tubes.

In an X-ray tube, X-ray flux is generated by an e-beam incident on a metal target when the incident electrons are stopped by the metal target. For a solid target, the X-ray flux is typically taken at about 90° from the e-beam direction, while for a transmission target, it is taken along the e-beam direction. For transmission targets, depending on the design, the X-ray flux can be predominantly either line-emissions whose energies are characteristic of the target element or bremsstrahlung (brem) flux whose energies are spread over a wide energy spectrum.

In current X-ray tube designs the amount of electrical energy to produce a given output flux is very high, causing heating of the target material and subsequent special target cooling considerations such as a rotating target, liquid cooling of the target, heat pipe cooling of the target, and others.

The energy spectrum of X-rays from tubes currently in the market is predominantly bremsstrahlung and can be changed by changing the energy of the e-beam impinging the target. As the e-beam energy is increased, the energy of the peak brem flux as well as the continuous brem X-ray energy spectrum shifts to a higher energy output. X-ray tubes used for imaging use this feature to provide higher energy X-rays for penetration of more X-ray opaque objects or parts of the body. For example X-ray tubes for medical imaging use e-beam energies of about 23–28 kV for mammography, 60 kV for dental and orthopedic imaging applications, about 130 kV for chest imaging applications and about 80–85 kV for abdomen and GI x-rays. The lower energy portion of the brem spectrum forms unwanted X-rays, which must be filtered out to decrease the residual radiation exposure of patients to harmful radiation. Even so there are significant problems with over exposure to X-rays in such applications as fluoroscopy, computed tomography, laminography and mammography. Filters reduce the harmful X-rays but do so at the expense of higher energy X-rays needed for imaging, which are also reduced in intensity. In addition filters, which are located at some distance from the focal spot generating X-rays, cause additional loss of quality through secondary fluorescent radiation knows as "filter blur".

Because of the high heat loads on targets of current X-ray tubes, the spot onto which the e-beam impinges on the target can not be decreased without serious target overheat considerations. Hence the spot size of the impinging electron beam is large with resultant loss of resolution of the image being obtained.

Although high efficiency end-window tubes with very thin metal foils to provide X-rays of substantially preselected characteristic energy have been disclosed, the output efficiency of these tubes has not reached its full potential.

Using a single target material in high efficiency end-window tubes producing characteristic X-rays does not allow for varying the energy of the X-rays as is traditionally done with brem tubes used for imaging. As e-beam energy is increased the total flux increases, but the output spectrum and resultant X-ray photon energy distribution of these tubes remains substantially the same. Thus the different X-ray energies needed to obtain images of differing object density and absorption cannot be obtained with a single high efficiency target material.

What is needed is a high efficiency, transmission X-ray tube capable of providing increased X-ray flux generation for a given electrical energy consumption and resultant heating of the target; X-rays of preselected characteristic energies which reduce the amount of unwanted radiation and focus the output energy at the levels required for optimum imaging; multiple X-ray targets to produce a combination of different bremsstrahlung and preselected k-line energies from a single tube with a single electron beam; a way to produce bremsstrahlung radiation in which the peak brem output energy does not increase with increasing impinging electron energies; reduced spot sizes for higher resolution images; lower cost and lighter weight X-ray generators; and very bright, high efficiency brem X-rays for applications which do not require the use of substantially preselected characteristic energy X-rays.

An X-ray transmission tube having a target including a thin metal coating such as silver on a stubstrate such as beryllium is described in Wang's U.S. Pat. No. 5,044,001 issued Aug. 27, 1991, the disclosure of which is incorporated herein by reference. An X-ray transmission tube having a target including a thin metal coating on a substrate such as beryllium is described in Wang's U.S. Pat. No. 5,627,871, dated May 6, 1997 the disclosure of which is incorporated herein by reference. In this patent a high efficiency transmission tube designed so that the peak energy of the electron beam is set at about 1.5 times the K-absorption edge of the target material and the target thickness is 0.1 to 2 μm. Generation of monochromatic or characteristic X-rays of high flux density is disclosed by Wang in his two patents. However, even though these monochromatic X-rays provide major advantages in a number of applications, the limited quantity of output flux still constrain the use of these tubes in even wider application.

Multi-targeted X-ray tubes are described in Hershyn's U.S. Pat. No. 4,870,671 the disclosure of which is incorporated herein by reference. In this patent for multiple target X-ray tubes, multiple e-beams are used to excite different target materials. In yet another disclosure of the same patent multiple target X-ray tubes have a differently oriented X-ray emitting surface for each target material and the resulting X-rays are individually collimated.

According to the present invention there is provided a target for a transmission X-ray tube of multiple target materials made of thin foils, on separate areas of a substantially planar substrate transparent to X-rays. A single electron beam impinges different target materials or different thicknesses of the same foil to produce X-rays of differing energies and characteristics determined at least in part by the characteristics of the foil, at least in part by the thickness of the foil, and at least in part by the energy and focal spot size of the impinging e-beam. A target is also provided for a transmission X-ray tube, which comprises at least two different foils, layered sequentially one on the other or onto a substrate substantially transparent to X-rays. An electron beam impinges the foil closest to the source of the electron beam, producing X-rays, which are, at least in part, determined by the characteristics and thickness of the target materials and further determined by the energy and spot size of the impinging electron beam. At lower e-beam energies characteristic X-rays from only one of the foils will be produced and at higher e-beam energies characteristic X-rays from all layers of foils will be produced.

Also provided according to the invention is an end-window X-ray tube comprising an evacuated housing; an end window anode disposed in said housing comprised of a target of at least one thin foil or a target of at least one thin foil deposited on to a substrate which is essentially transparent to X-rays; a cathode disposed in the housing which emits an electron beam, which proceeds along a beam path in the housing to strike the anode in a spot, thus generating a beam of X-rays which exits the housing through the end-window; a power supply attached to the housing adjacent to the cathode providing an electron beam of selected energy to produce a bright beam of X-rays of a preselected characteristic energy; where the electron beam energies are higher than 100% above the preselected k-alpha energy of the X-rays and as high as twenty times the preselected k↦ energy of the output X-rays; and where said foil's thickness is between 2 and 50 lm (micrometer) and is chosen to provide a bright source of X-rays. The X-ray beam may be optionally focused onto, above or below the surface of the end-window target.

Also provided according to the invention is an end window X-ray tube comprising, an evacuated housing, an end window adone disposed in said housing comprised of a target of at least one thin foil or at least one thin foil deposited on a substrate substantially transparent to X-rays, a cathode in said housing which emits an electron beam, which proceeds along a beam path in said housing to strike said anode in a spot, generating a beam of X-rays which exits the housing through the end window, a power supply connected to said cathode providing a selected electron beam energy to produce a bright beam of X-rays characteristic of the target foil or foils, wherein the thickness of the foil target is less than two times the electron penetration depth of the electrons striking the target, and the thickness of the foil is chosen to be between 2 and 50 lm (micrometer) to produce a bright source of generated bremsstrahlung X-rays.

Also provided according to the invention is an end-window X-ray tube comprising an evacuated housing; an end window anode disposed in the housing comprised of a thin foil, either a free standing foil or a foil deposited on a substrate substantially transparent to X-rays; a cathode disposed in the housing which emits an electron beam, which proceeds along a beam path in the housing to strike the anode in a spot, thus generating a beam of X-rays which exits the housing through the end-window; a power supply attached to the housing adjacent to the cathode providing an electron beam of an energy below the threshold energy required to produce a bright beam of X-rays of a preselected K-line energy; and said foil's thickness chosen to provide a bright source of predominantly bremsstrahlung X-rays and is between 2 and 25 lm (micrometer). The X-ray beam may be optionally focused onto above or below the surface of the end-window target. The substrate may be optionally made of beryllium, aluminum or an alloy of the two.

The spot onto which the electron beam impinges the target may be optionally moved to change the impinging location for the above described targets and end-window X-ray tubes.

Further provided is an end-window tube which produces X-rays used in general medical imaging, mammography, angiography, cardiovascular imaging, bone densitometry imaging, dental imaging, circuit board imaging, radiation treatment, and integrated circuit imaging utilizing radiographic, fluoroscopic, laminographic, computed tomographic, and multiple energy X-ray techniques to obtain images. An end-window X-ray tube is provided for incorporation in C-arm and portable x-ray equipment. An end-window tube is provided for use in inspecting integrated circuits and circuit boards, non-destructive evaluation of objects including luggage and shipping containers, and general X-ray fluoroscopy used in non-destructive testing applications. Further provided is an end-window tube which is useful in treating certain diseases by killing or altering biological samples.

BRIEF DESCRIPTION OF DRAWINGS

FIG. 14 is a graphical representation of the output energy spectrum of X-radiation produced from tungsten targets of two different thicknesses with varying accelerating electron energies. X-ray energies increase with the increasing X-axis.

Note: Measurements of flux intensities for data and for definitions used in this invention have been done with a Model 2026 C Radiation Monitor with a Model 20x6-6 Detector from Radical Corporation. Measurements of the energy spectrum of X-rays output from various configurations of X-ray tubes have been made with a Model PXZT-CTZ Spectra Meter with a Model XR-100T-CTZ Detector from Amtek Inc.

In one embodiment of the invention an X-ray target has multiple thin foils of electrically conducting material coated onto separate areas of a substantially planar substrate which is substantially transparent to X-rays. Although such foils are usually made of a metal or an alloy of a metal, there are conducting polymers which can likewise contain elements which are also capable of producing X-rays according to the current inventions. Examples of such conducting polymers includes but is not limited to polyacetylene or melanin, polyanilene and poly-o-anisidine. All elements which are capable being deposited onto a substrate in some form can be used to produce X-rays of the current invention. Such depositions include but are not limited to silicon with degenerate p type doping of boron or n type doping of arsenic, antimony or phosphorous which can be deposited by sputtering onto either an aluminum or beryllium substrate. The target can be employed in an X-ray transmission tube for selective emission of X-ray flux of different energies by switching the location of the spot where the e-beam impinges the target to different foils. The foil onto which the e-beam impinges can be selected prior to applying power to the X-ray tube if a single energy spectrum is desired or the e-beam may be sequentially moved from one location to another to produce multiple images of the same object with different X-ray energy spectrums.

Figure 1:
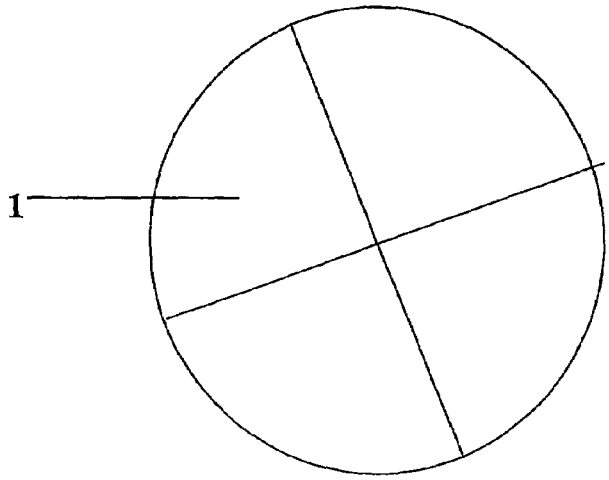
FIG. 1 is a graphical representation of the top view of a circular target with four different foils deposited on the target in four different regions of the same plane.

FIG. 1 depicts the top view of a circular target with four different foils deposited on a single target. Although for demonstration purposes the target materials in a typical section (1) with a single foil are shown as four equally divided and similar geometric shapes, any geometric shape of any size large enough to focus the e-beam spot and any number of different foils may be used. The thickness of each foil as well as thickness variations within each foil may vary depending on application. One method of depositing the foils is by using a mask to expose each area of the substrate on which a target material may be deposited using any technique known to those skilled in the art while protecting other areas of the substrate from deposition. Each foil can be deposited in a similar way.

The thickness of the film is variable depending on the foil material, the energy of the impinging e-beam, tube life, self filtering of the output flux by the foil, and the desired type of X-ray emission, either line, brem or a combination of these.

Figure 10:
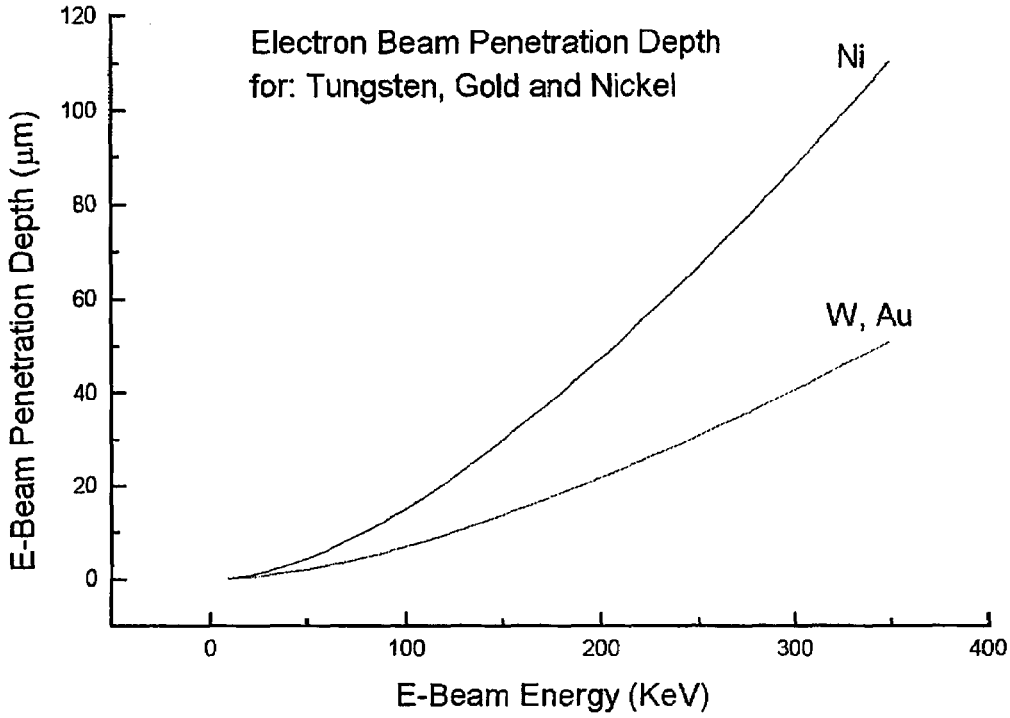
FIG. 10 is a graph of the depth of penetration of the e-beam into gold and tungsten targets as a function of the e-beam energy.

FIG. 10 shows the depth electrons penetrate into target materials of gold and tungsten as a function of the e-beam energy. By choosing the target thickness the mixture of brem and characteristic k-line X-ray production can be adjusted.

Figure 6:
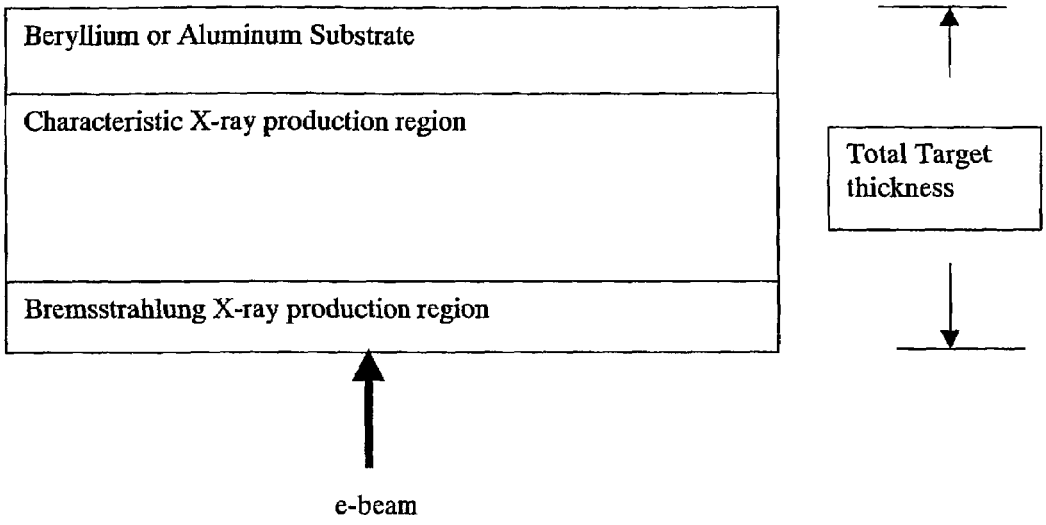
FIG. 6 is a diagrammatic representation of the thin target of the invention.

When electrons of energy E penetrate into single foil target or onto one of multiple foil targets of the current invention, the penetration depth of electrons into a target is given by the well-known formula:

$$R=4120\times E(1.265-0.0954\ \ln E)/\square$$

where R is the penetration in microns, E is the primary electron energy in MeV, and □ is the absorber density in grams per cubic centimeters of the target. This formula is appropriate for electron energies of 10 keV to 3 MeV. For purposes of this patent, by definition when the thickness of the thin foil target is less than twice the electron penetration depth, the tube produces predominantly bremsstrahlung radiation. Referring to FIG. 6 high energy electrons enter the target in the region labeled "Bremsstrhalung X-Ray Production Region". When this region is thinner than the subsequent region labeled "Characteristic X-ray Production Region" there is sufficient target material available to change the incoming source bremsstrahlung X-rays into characteristic X-rays by the process shown in FIG. 9. If the region producing characteristic x-rays is thinner than the region producing bremmstrahlung X-rays, then there is insufficient production of characteristic X-rays and the output of the tube is considered to be predominantly bremsstrahlung by the above definition. FIG. 10 shows a plot of the penetration depth of Nickel, Tungsten and Gold as a function of the energy of the E-Beam. FIG. 16 illustrates the spectrum of output energies for differing tube voltages providing the accelerating energy for the E-Beam. The target thickness is 25 lm (micrometer). When the tube voltage exceeds 80 kV, the penetration depth of the electrons in the Nickel target is about 12.5 lm (micrometer) or half of the target thickness. By definition X-rays output from this target configuration above about 80 kV are predominantly bremsstrahlung. FIGS. 16D through 16H illustrate that there is very little increase in the characteristic k-line output from the target, but that the total radiation increases from 371 mRad/min at 80 kV tube voltage to 703 mRad/min at 110 kV using the same tube current of 50 lamps (microamperes). The increase in radiation is in the bremsstrahlung portion of the spectrum.

For electron energies of 150 keV, the penetration depth of the electron into either a gold or tungsten target is approximately 10 microns. Thus for a target thickness less than 20 microns and an accelerating voltage of 150 keV, predominantly bremsstrahlung radiation is produced. An example of such brem radiation is shown in FIG. 14B. The penetration depth of electrons of 100 kV is greater than 5 microns. A single foil target has a target thickness of only five microns, which is less than two times the penetration depth of the electrons, and hence the radiation is predominantly bremsstrahlung radiation.

For many applications x-rays with a high percentage of K-line radiation are desired over bremsstrahlung radiation. FIGS. 4, 5, 16A–D, 17 and 18 show examples of target materials, foil thickness, tube voltages and resultant X-ray energies from five different X-ray tubes whose targets are chosen to provide characteristic preselected K-line radiation. This kind of K-line radiation is useful in many applications as will be explained later.

There are applications where the L-line radiation is more useful than K-line radiation. For example to excite Bromine atoms to produce Auger electrons for uses including but not limited to X-ray lithography and medical therapeutic applications, maximum numbers of Auger electrons are produced when the exciting energy is slightly greater than K absorption of Bromine, 13.475 keV. The $L\mapsto^{1}$ line of Uranium is 13.613, just above the K absorption of Bromine, and provides a high efficiency source of X-rays to produce Auger electrons from Bromine. It is more advantageous to use Uranium for the foil target as there are no practical target materials which will produce K-line radiation with the same efficiency in releasing Auger electrons from Bromine.

Figure 15:
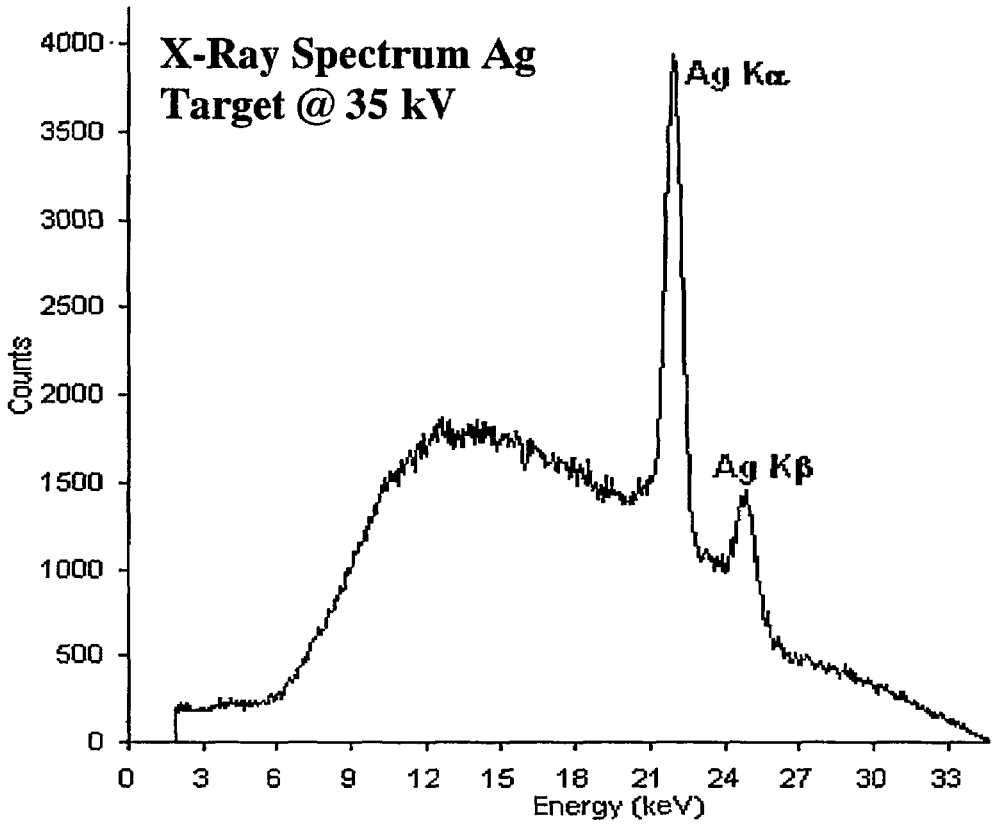
FIG. 15 is a graphical representation of the output energy spectrum of X-radiation produced from a conventional X-ray tube with a solid silver target and an excitation voltage of 35 kV.
Figure 16A:
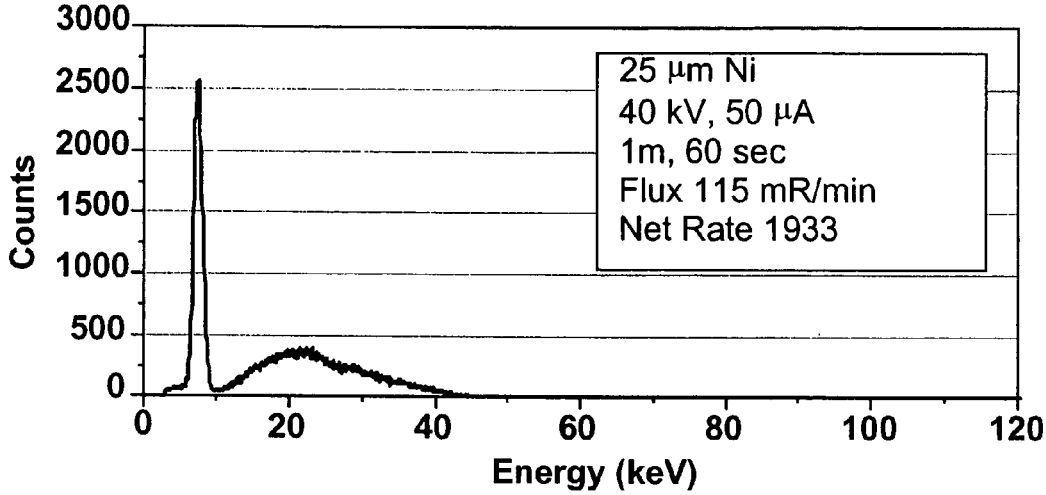
FIG. 16 is a is a graphical illustration of the output energy spectrum line emission of X-rays compared to bremmstrahlung emission of X-rays using different X-ray tube voltages up to 110 kV for the electron beam impinging a nickel free standing foil 25 lm (micrometer) thick with no substrate. X-ray energies increase with the increasing X-axis.
Figure 16B:
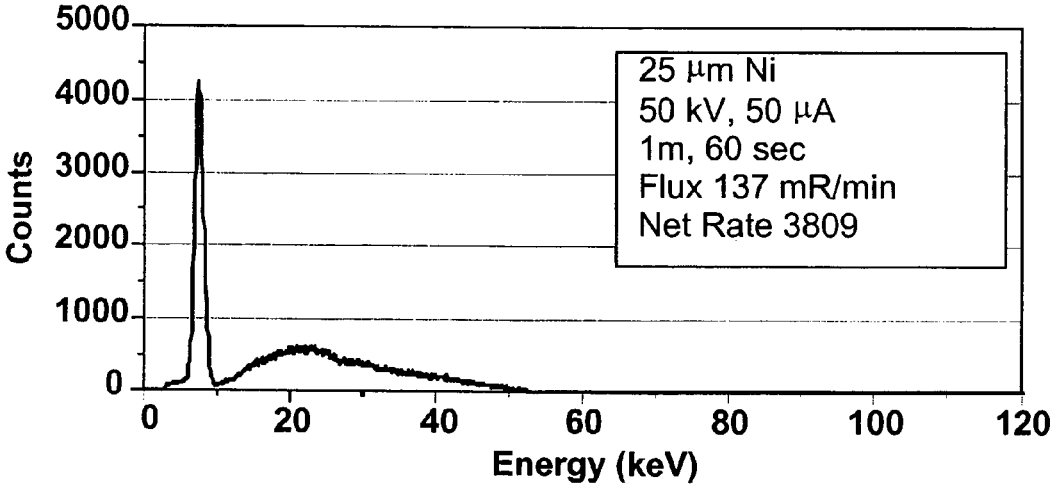
Figure 16C:
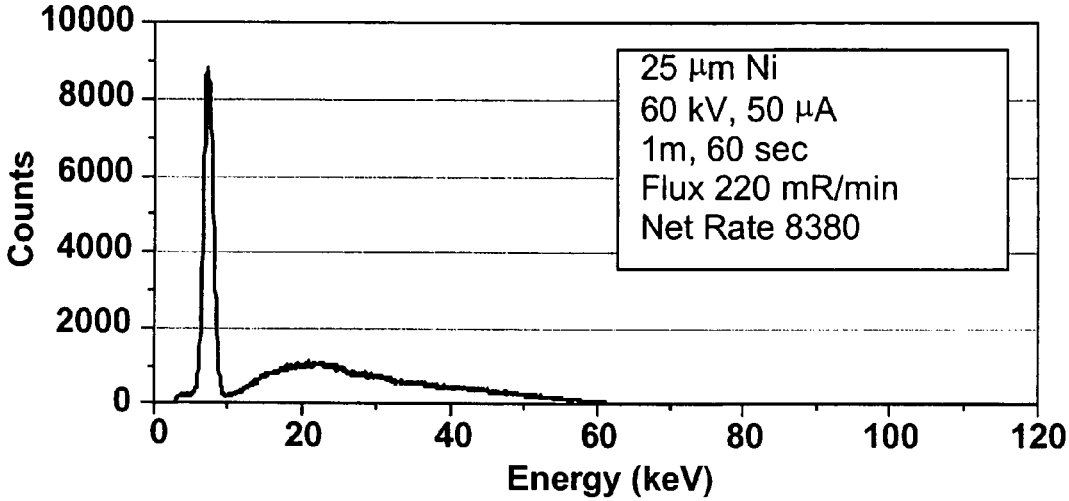
Figure 16D:
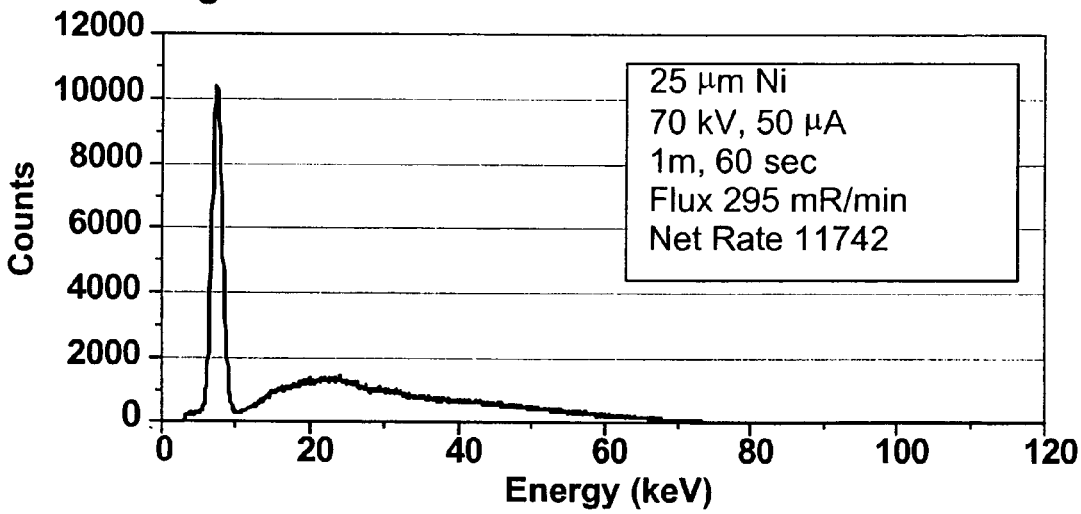
Figure 16E:
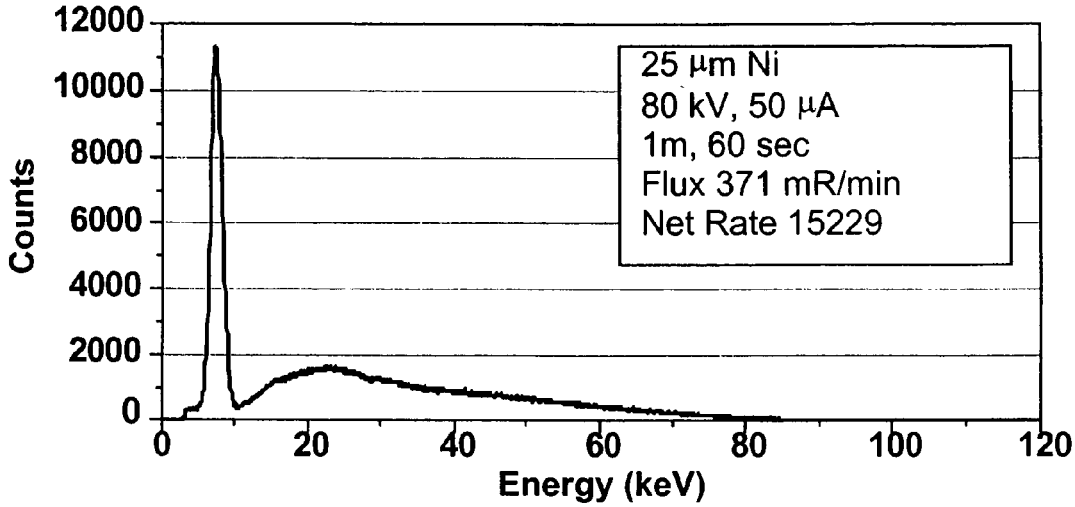
Figure 16F:
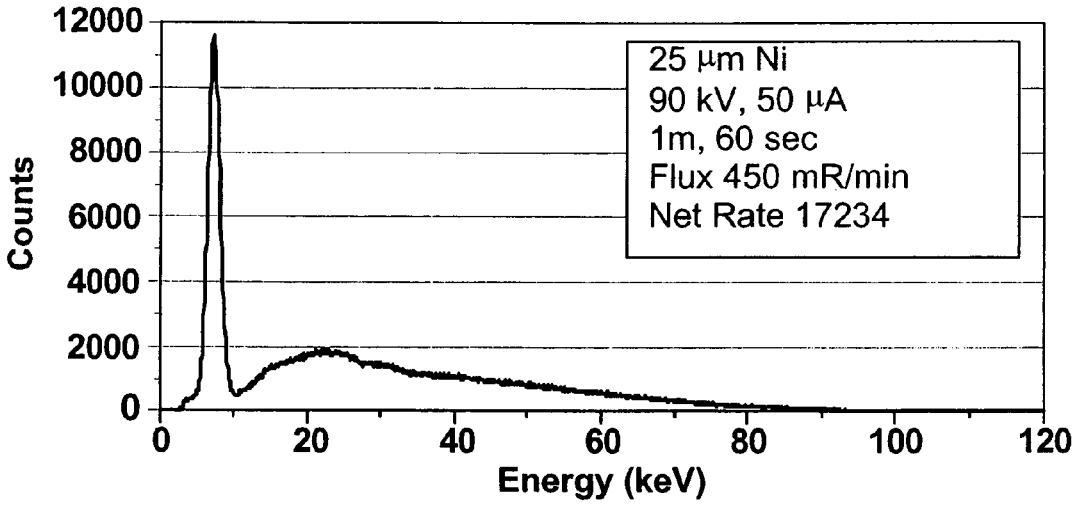
Figure 16G:
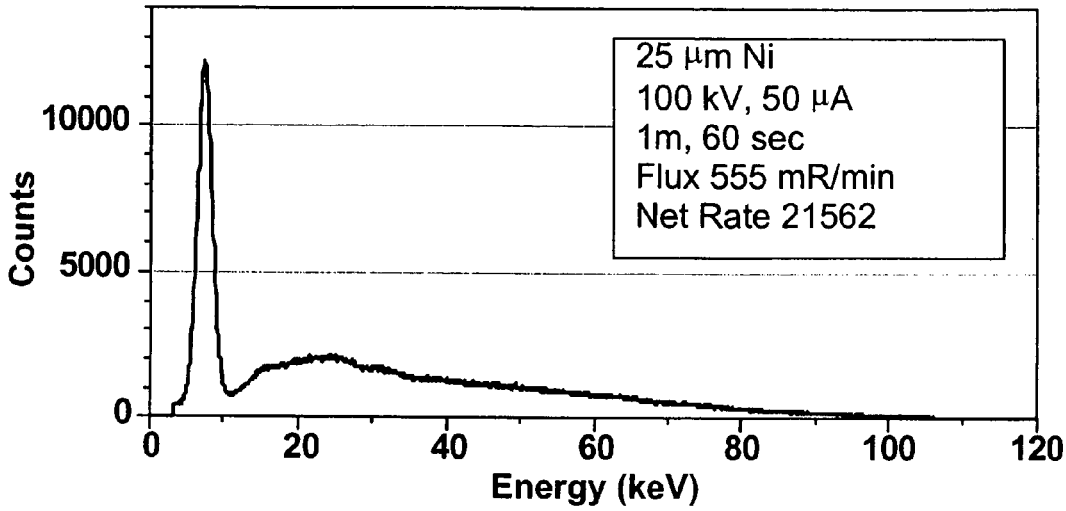
Figure 16H:
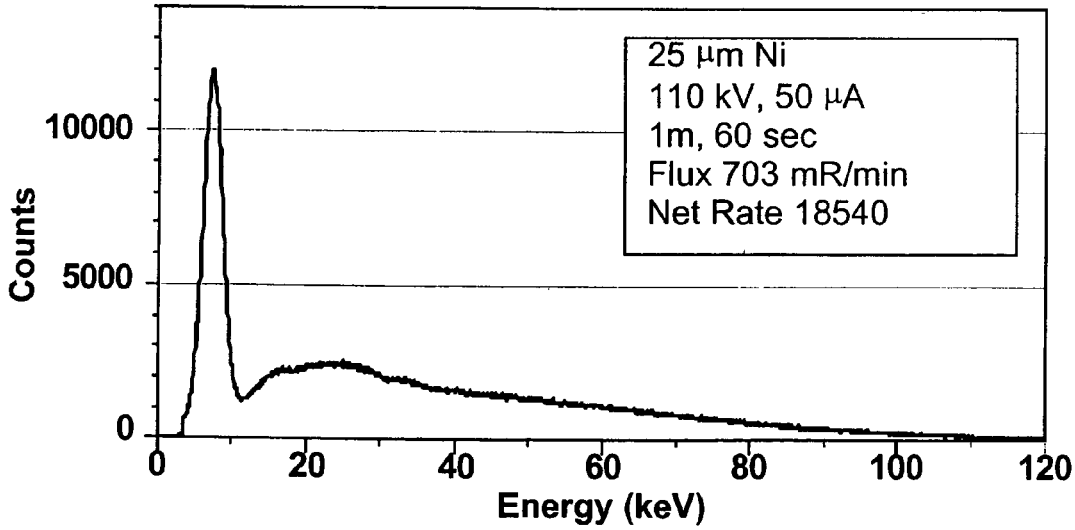
Figure 17A:
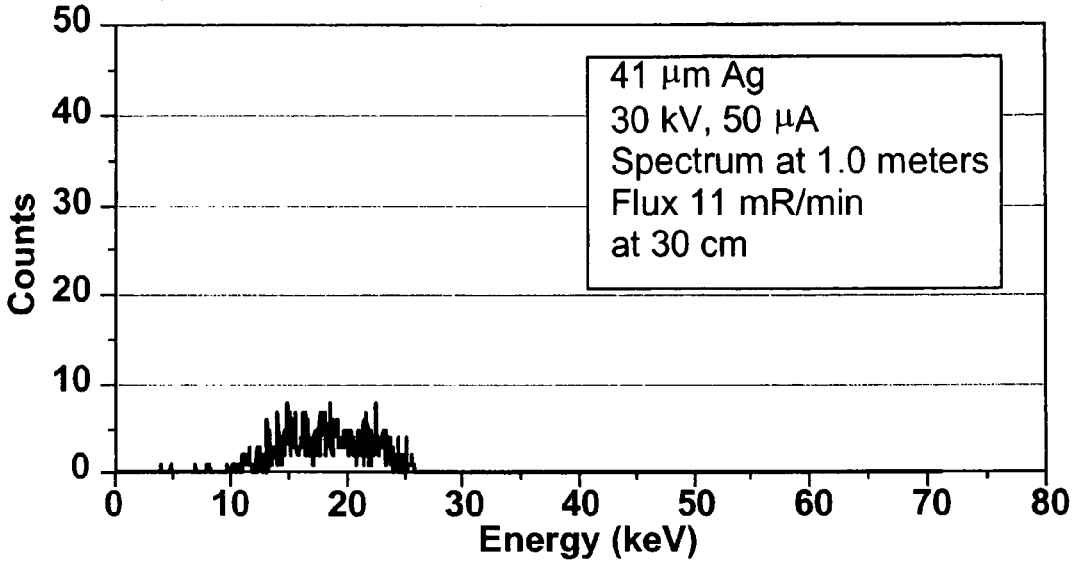
FIG. 17 is a graphical illustration of the line emission of X-rays using different accelerating voltages for the electron beam impinging a silver target 41 microns thick deposited on a substrate of beryllium. X-ray energies increase with the increasing x-axis.
Figure 17B:
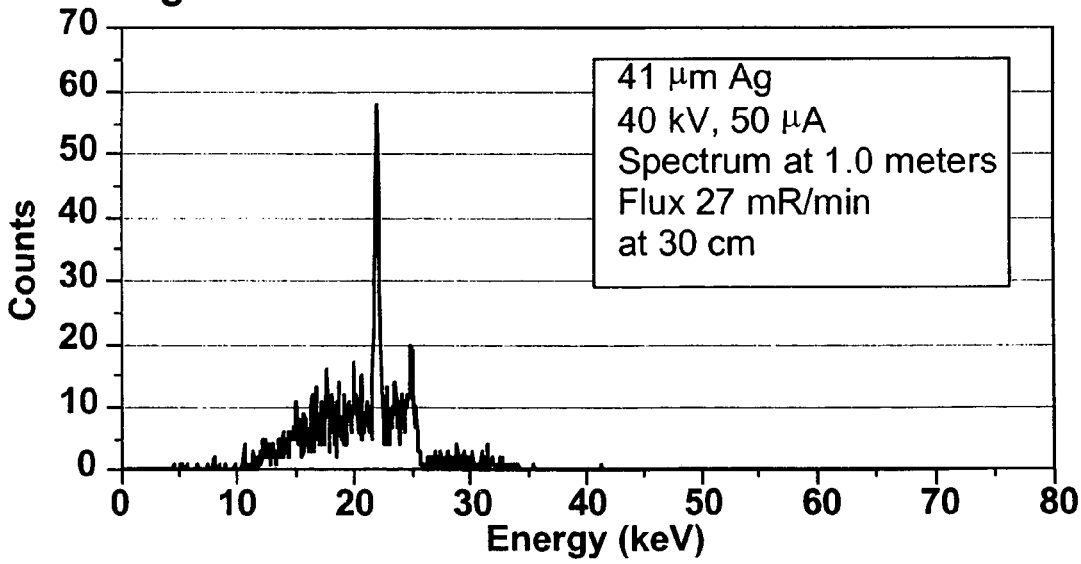
Figure 17C:
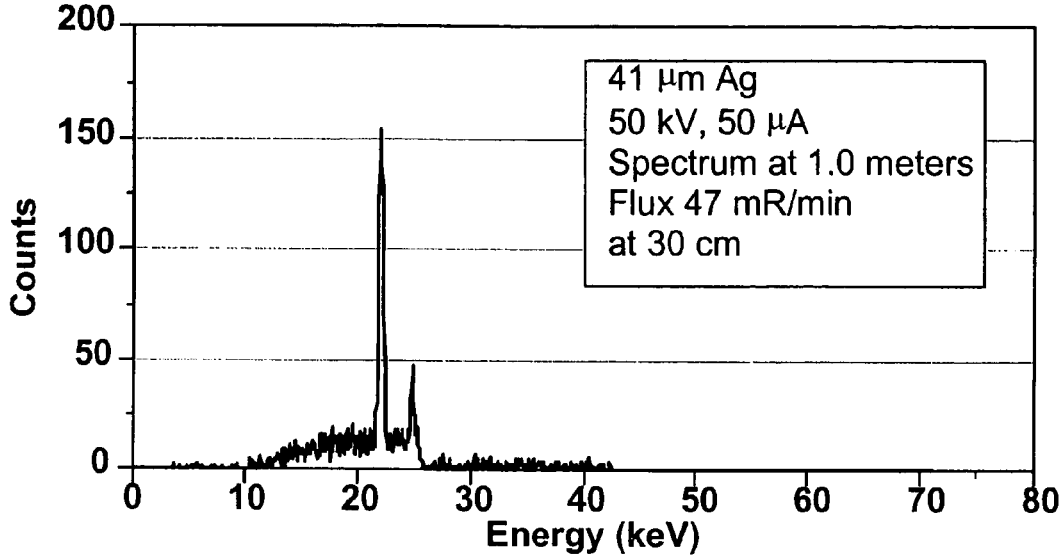
Figure 17D:
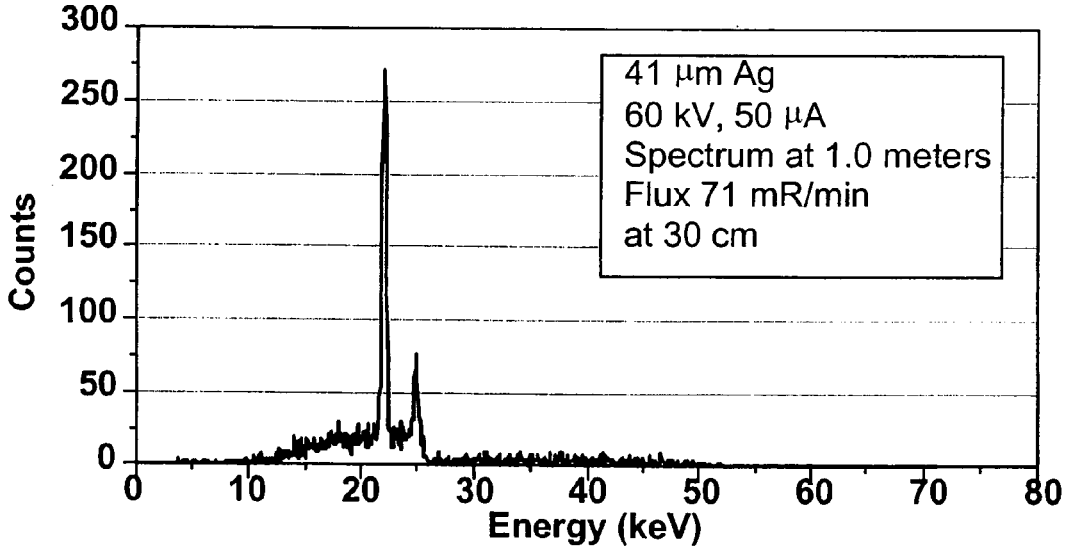
Figure 17E:
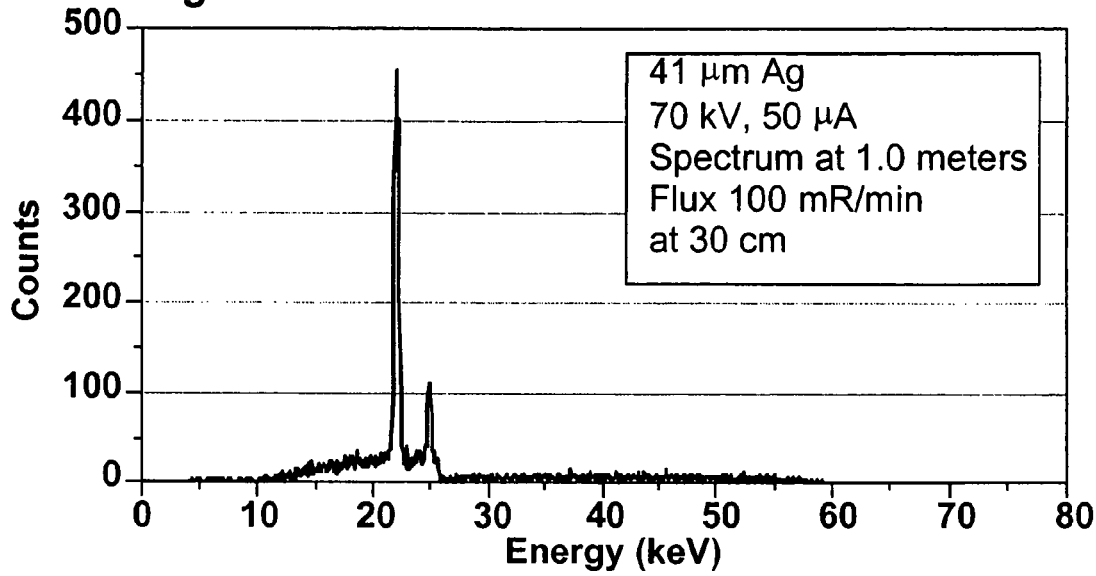
Figure 17F:
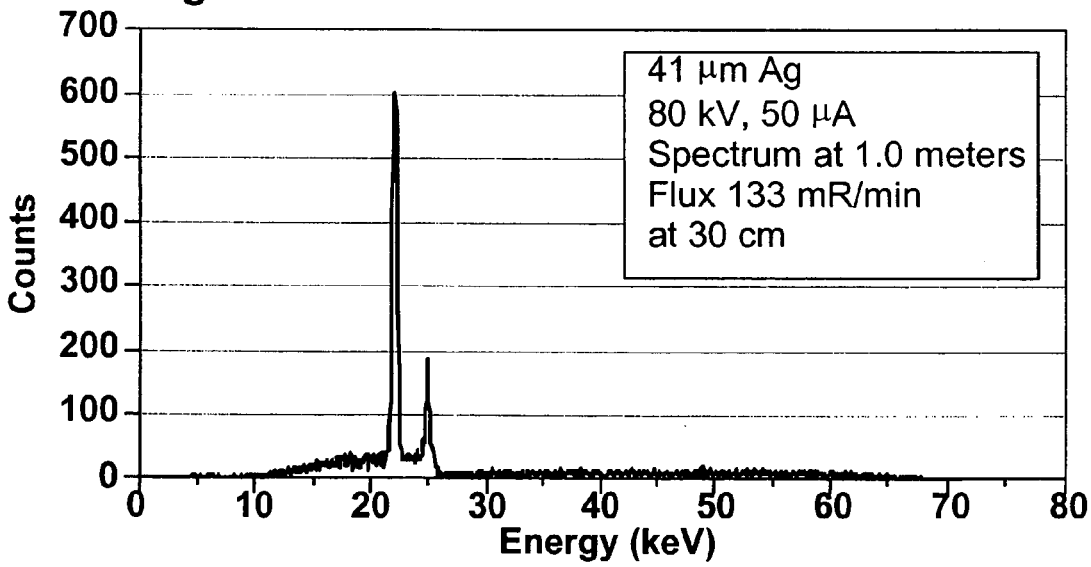
Figure 17G:
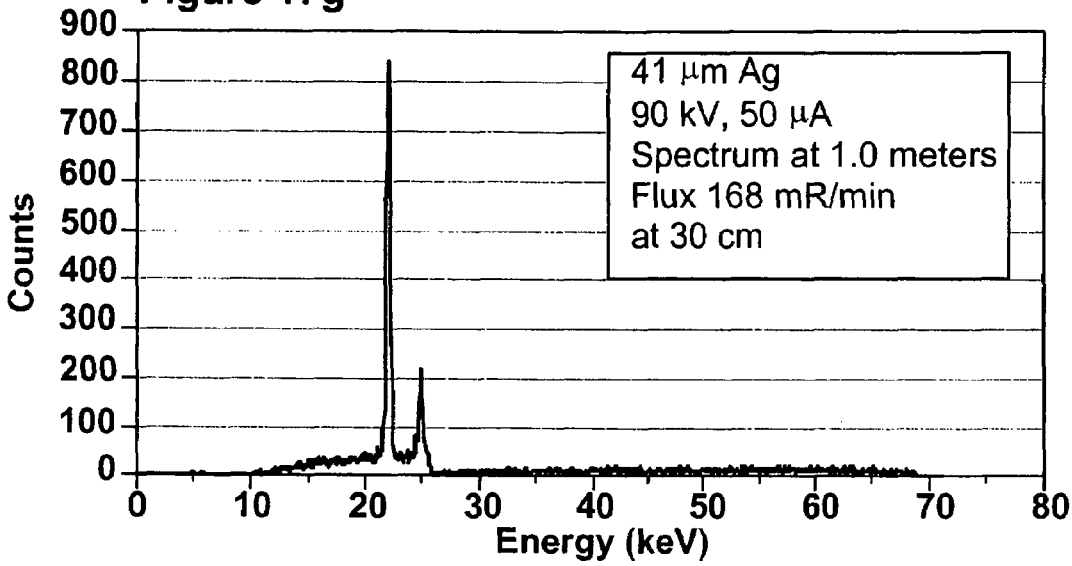
Figure 17H:
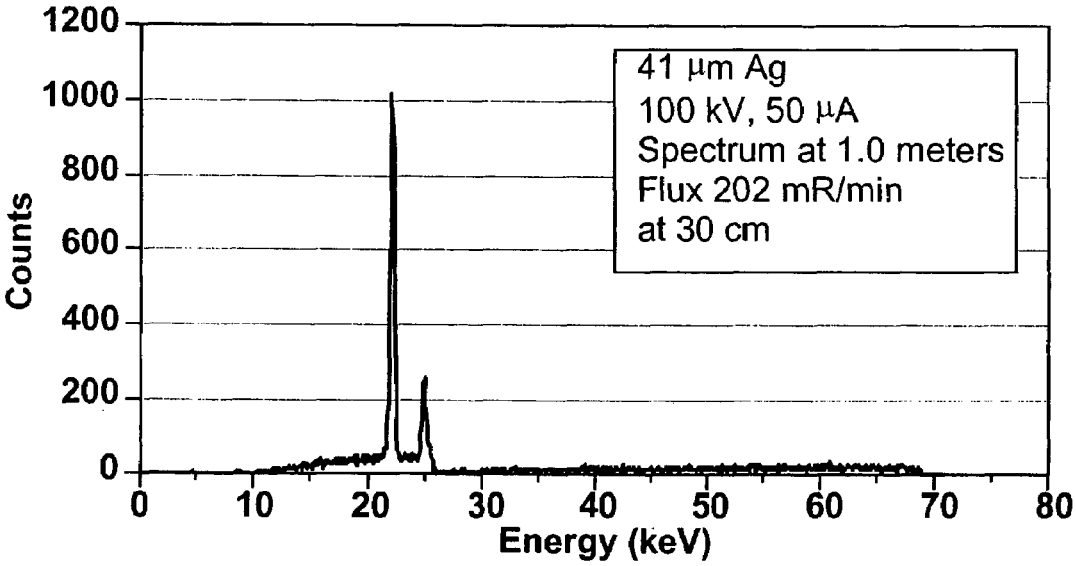
Figure 18A:
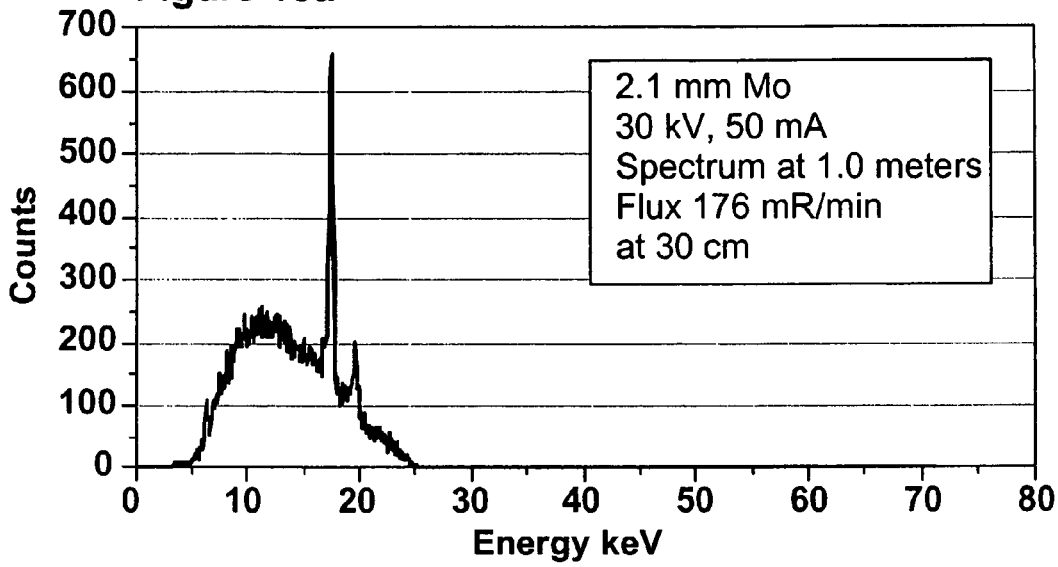
FIG. 18 is a graphical illustration of line emission nature of X-rays obtained by using four different accelerating voltages for the electron beam impinging a 2.1 micron thick molybdenum target deposited on a beryllium substrate.
Figure 18B:
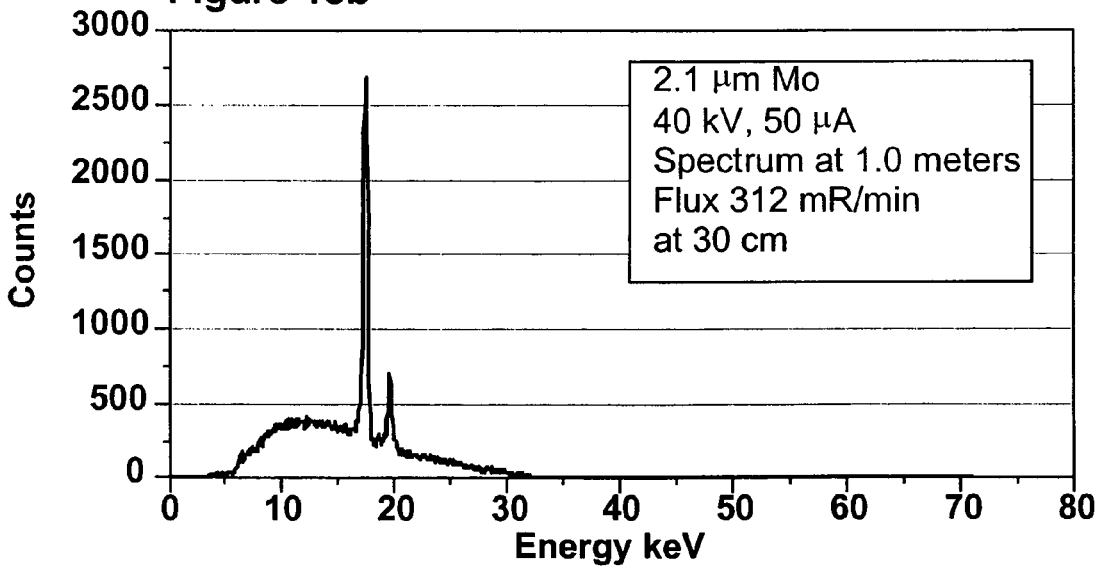
Figure 18C:
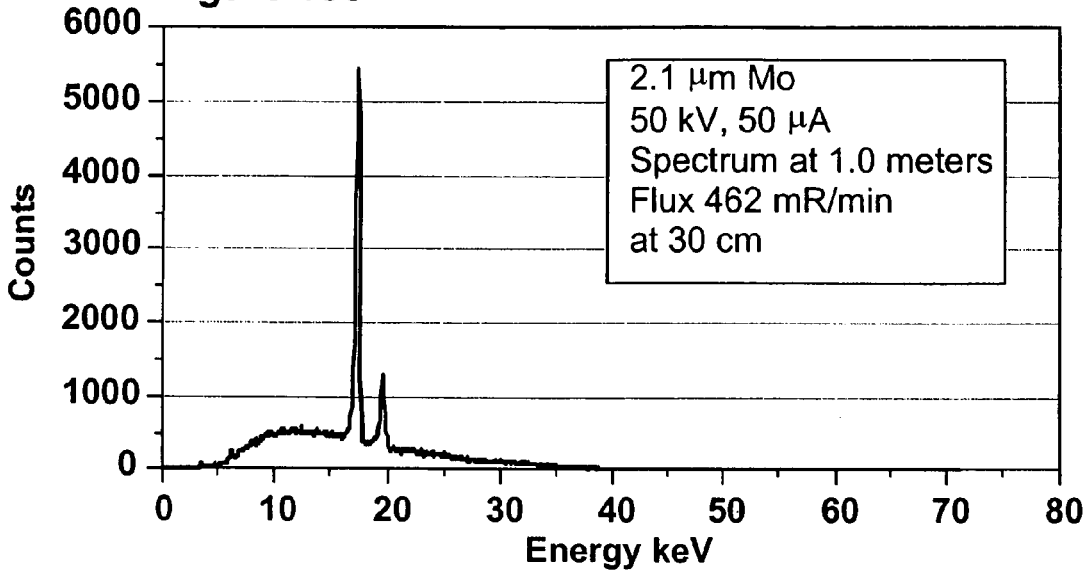
Figure 18D:
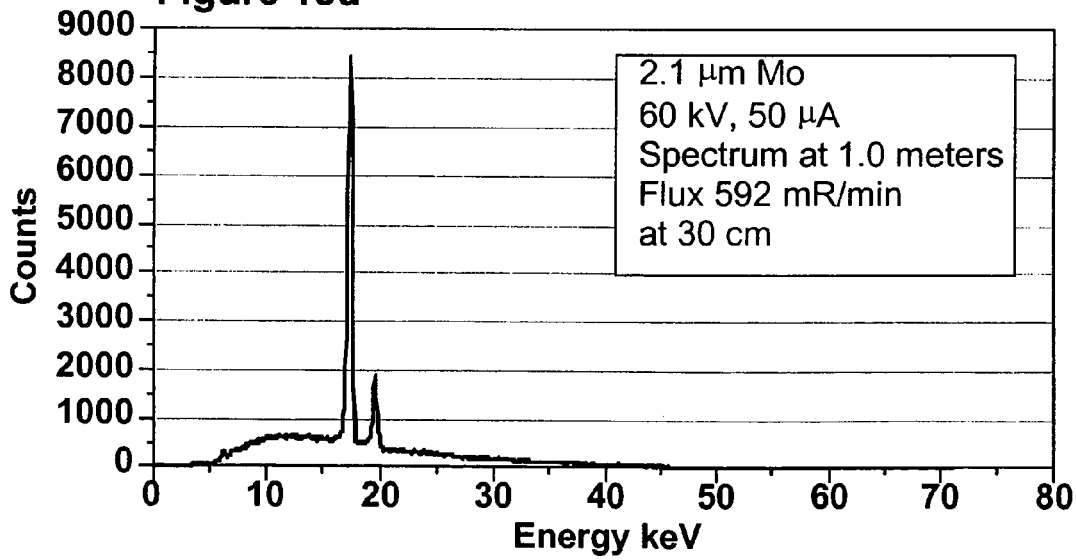
Figure 18E:
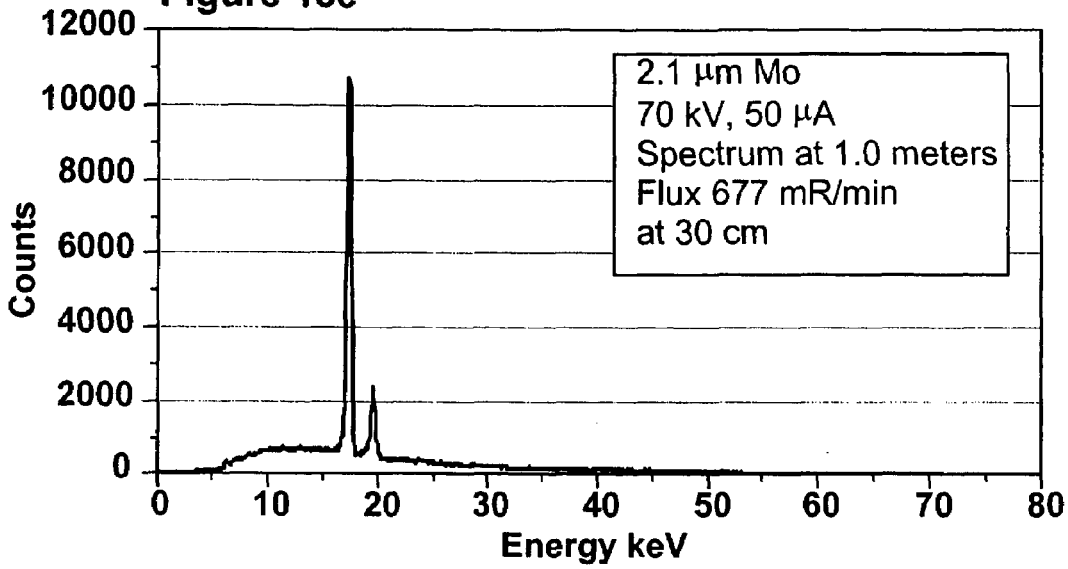
Figure 18F:
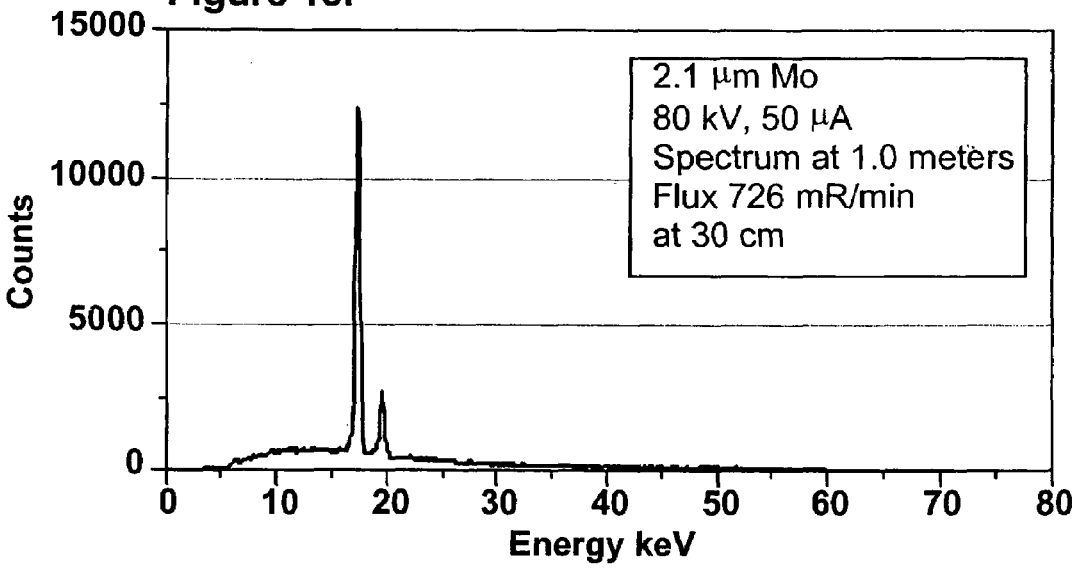

The threshold energy required to produce x-rays of a preselected energy characteristic of the target material is herein defined as the electron beam energy which produces k-alpha flux densities which are two times as strong as the strongest bremsstrahlung flux as measured with the instruments described above. Again by definition when the energy of the impinging electrons is less than the threshold energy, the resulting x-radiation is predominantly bremsstrahlung. Referring to FIG. 15, the relative flux density in counts for the k-alpha characteristic lines of a solid silver target register 3,900 counts at the k-alpha energy of silver of 22.162 keV. The strongest bremsstrahlung energy occurs at approximately 12 keV and it has a relative flux density of about 1,900 counts. This data was taken for an electron accelerating voltage of 35 kV. The threshold energy to produce x-rays of a preselected energy for this target configuration is thus slightly less than 35 kV. Referring to FIGS. 14C and 14D, the accelerating energies used to obtain X-rays from a single tungsten target 25 microns thick is clearly less than the threshold energy for this target configuration and the resulting radiation is predominantly bremsstrahlung. Comparing FIG. 14D to 14B, the thicker 25 micron target of FIG. 14D "self filters" the L-line and other lower energy X-rays seen in the thinner 5 micron target and is hence useful in applications where low energy x-rays are unwanted, even though the flux density output from the thicker target may be less than from the thinner target. The filtering in accordance with the present invention is done by the thickness of the target and hence very close to the source of the X-rays eliminating "filter blur" which is caused by secondary emission from a filter conventionally located at a distance from the spot on the target which generates X-rays. This is a significant advantage of the current invention used by but not limited to medical imaging where low energy x-radiation can cause damage to animal and human tissue and NDT applications where high levels of low energy radiation can cause saturation of digital sensors.

Figure 4A:
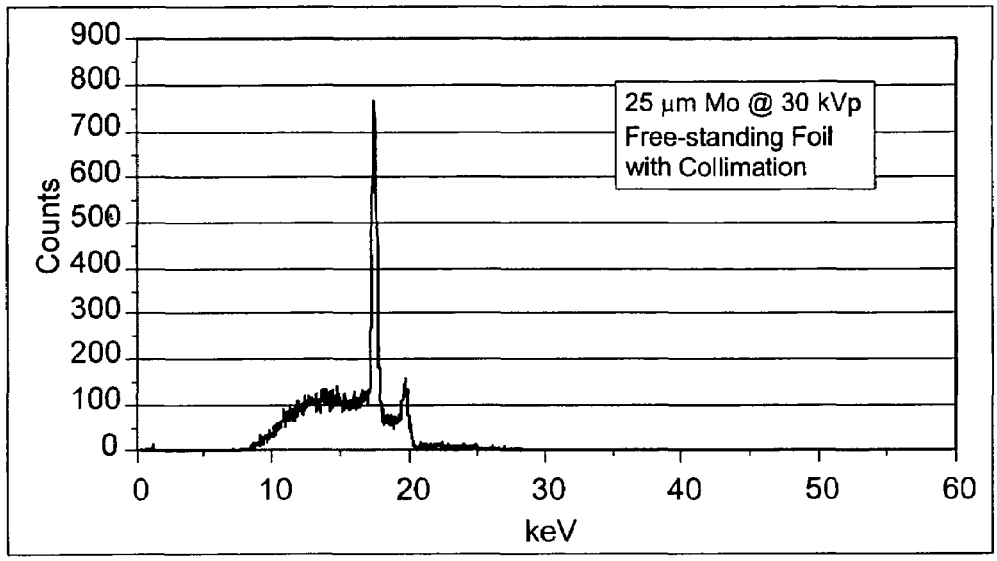
FIG. 4 is a graphical illustration of line emission nature of X-rays obtained by using four different accelerating voltages for the electron beam impinging a 25 micron thick free standing foil molybdenum target with no substrate.
Figure 4B:
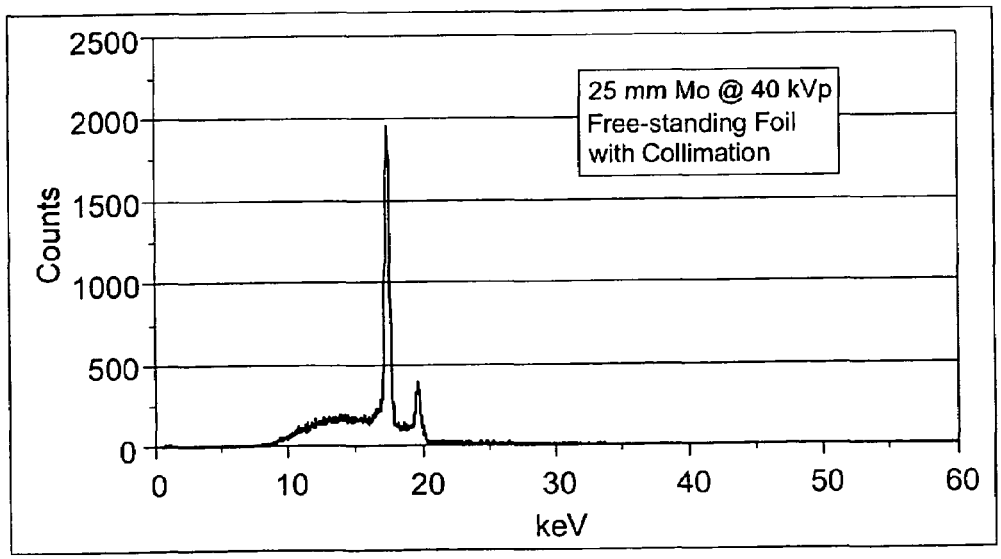
Figure 4C:
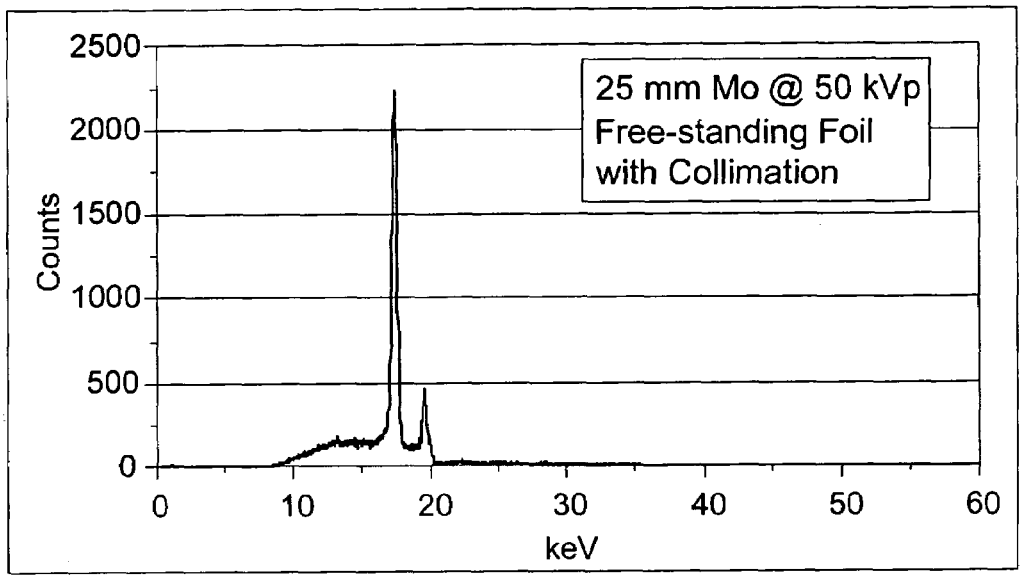
Figure 4D:
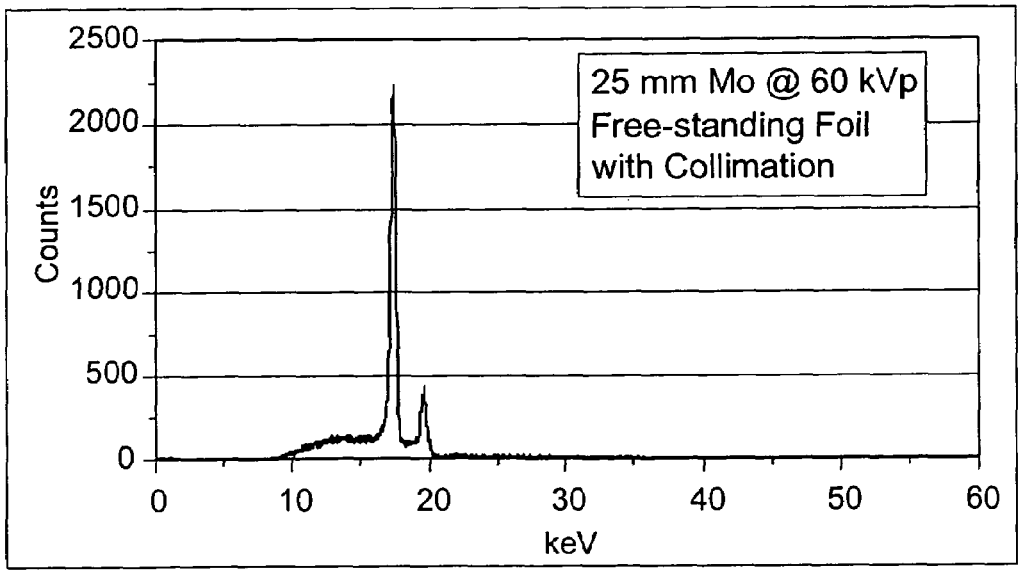
Figure 5A:
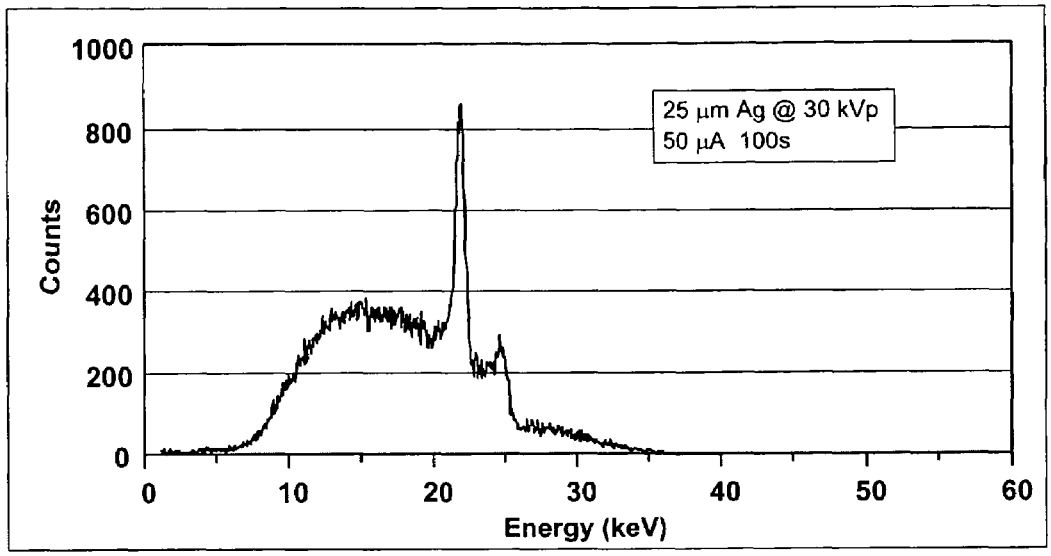
FIG. 5 is a graphical illustration of the relative intensity of flux of line emission X-rays obtained by using the same exposure time, the same tube current and varying the accelerating voltage of the electrons impinging the target for a target material of silver.
Figure 5B:
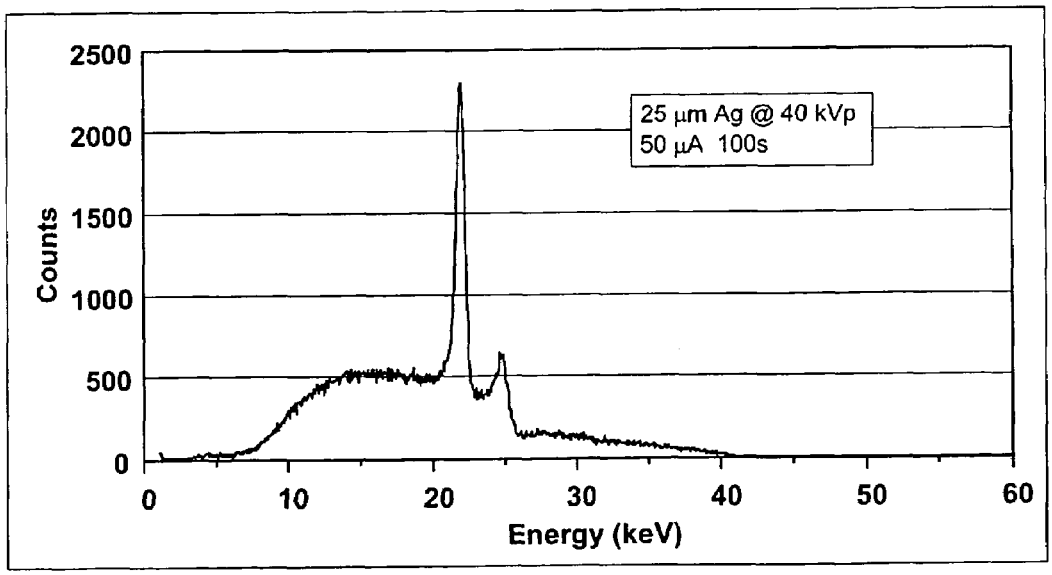
Figure 5C:
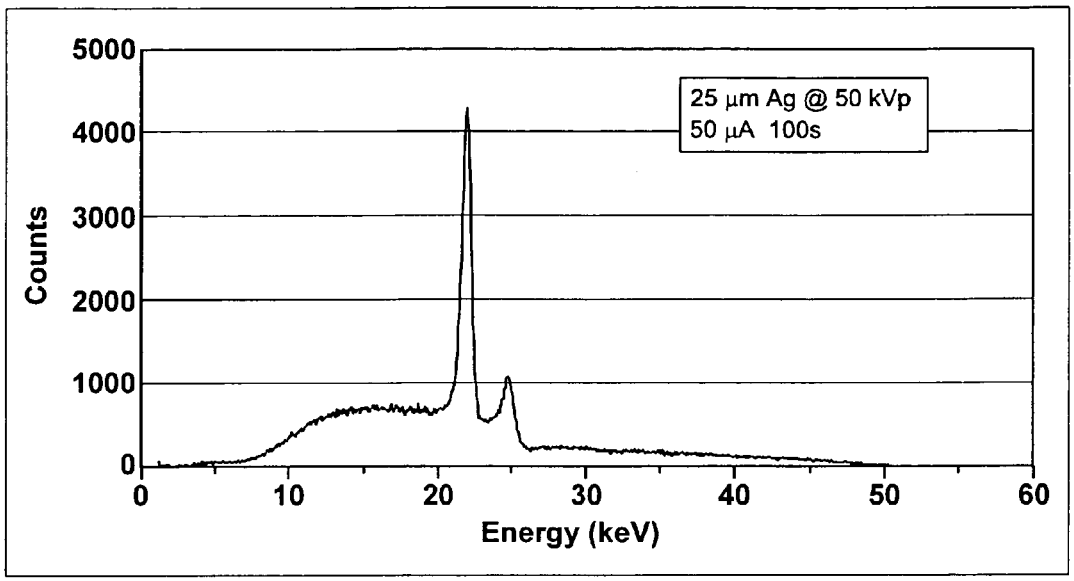
Figure 5D:
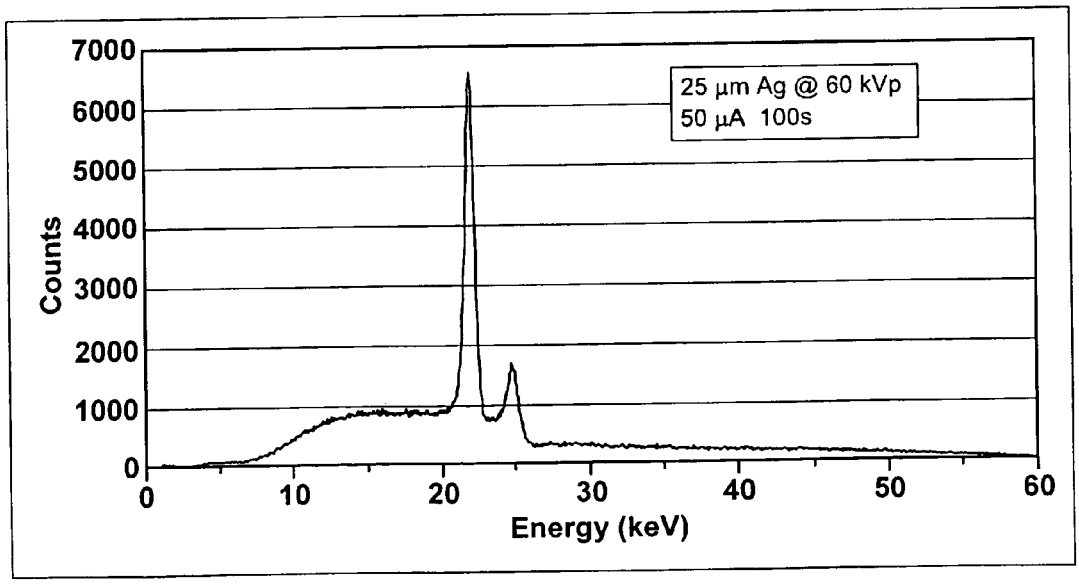

If the thickness of the foil is too thin, the target will not provide self filtering obtained when lower energy X-rays generated by electrons first entering the target are absorbed by subsequent thickness of the foil. Therefore selection of the target thickness includes considerations of total flux required, e-beam energy used, self filtering by the foil of lower energy X-rays, proportion of brem to characteristic X-ray output desired, and tube life among other factors. For example, at e-beam energies of 50 kVp the penetration depth of the electrons in gold and tungsten is about 2.5 lm whereas at 250 kVp the penetration is about 30 lm (micrometers). The thickness of the target foil may range from more than 50 μm to about 0.25 μm or even below. The thickness required to provide substantially characteristic k-line X-rays varies with material and e-beam energy. For example, As shown in FIGS. 4B, C and D, substantially characteristic K-line x-rays can be obtained by using a thin foil of molybdenum (k↦ of 17.478) with a thickness of 25 μm with e-beam energies greater than 40 kV. FIG. 18 shows the flux generated from a molybdenum target 2.1 microns thick. At lower tube voltages, the flux density for the 2.1 micron thick target is considerably higher than for the 25 micron target. X-ray tube brightness is about 35% brighter for a foil thickness of 10 μm than for a thickness of 25 μm for photon energy at select tube voltages.

In one embodiment of the current invention the target material, the accelerating energy of the electron beam and the thickness of the target are chosen, for at least one of the multi-target materials as illustrated in FIG. 1, the voltage is below the threshold energy required to produce X-rays of a preselected k-line energies of the target foil but instead produces a broad spectrum of bremsstrahlung radiation. In another embodiment at least two of the multiple separate areas contains foils made of the same materials but of different foil thickness. In yet another embodiment for at least one of the multiple target areas, the accelerating electron voltages are chosen so that the thickness of the foil target is less than two times the electron penetration depth of the electrons striking the target, producing predominantly bremsstrahlung radiation. Similarly when only a single target is used with an X-ray tube of the current invention, any of the above described bremsstrahlung outputs can be obtained.

Applications of X-ray transmission tubes utilizing target configurations of the current invention include but are not limited to using a single tube with multiple target materials or target thickness to provide medical images with substantially characteristic line X-rays or a combination with substantially bremsstrahlung radition of many different parts of the human or animal body with a single X-ray tube whereas currently different tubes are needed for different specialized imaging protocols. Another application is to replace less efficient X-ray tubes with substantially the same energy spectrum, typically substantially bremsstrahlung radiation, with a tube capable of producing much greater output flux than current tubes for the same tube current, thus reducing the size and cost in such applications. Another application is in dual energy imaging for both medical imaging and non-destructive testing applications. Dual energy imaging done with two different energies from one or more substantially brem X-ray producing tubes suffers from a lack of X-ray photons at the critical absorption energies and from a clear energy separation of the X-ray energies output from both e-beam energies. A transmission tube using a target of the current invention provides significantly more focused energy at the critical absorption energies and provides substantially characteristic X-ray energies with very clear separation of energies. With the current invention it is possible to use more than two X-ray energies and to add and subtract images in any way to provide an improved image. Some examples include but are not limited to subtracting unwanted images of fatty tissue in a mammogram from images of potential cancer lesions, removing bone images from chest X-ray images, bone densitometry using standard dual photon absorptometry techniques, subtraction angiography and many other dual energy imaging applications known to those skilled in the art in both non-destructive testing and medical imaging. This type of target is especially helpful in multiple energy imaging for non-destructive testing of electronic circuit boards and integrated circuits.

In mammography applications it is possible to use a combination of two or more thin foils deposited on a substrate as shown in FIG. 1 where some of the possible foils include but are not limited to Mo, Y, Rh, and Ag. Each of these foils could be used to image breasts of different densities. An e-beam can be made to impinge on the appropriate target material for each category of breast density.

Figure 3:
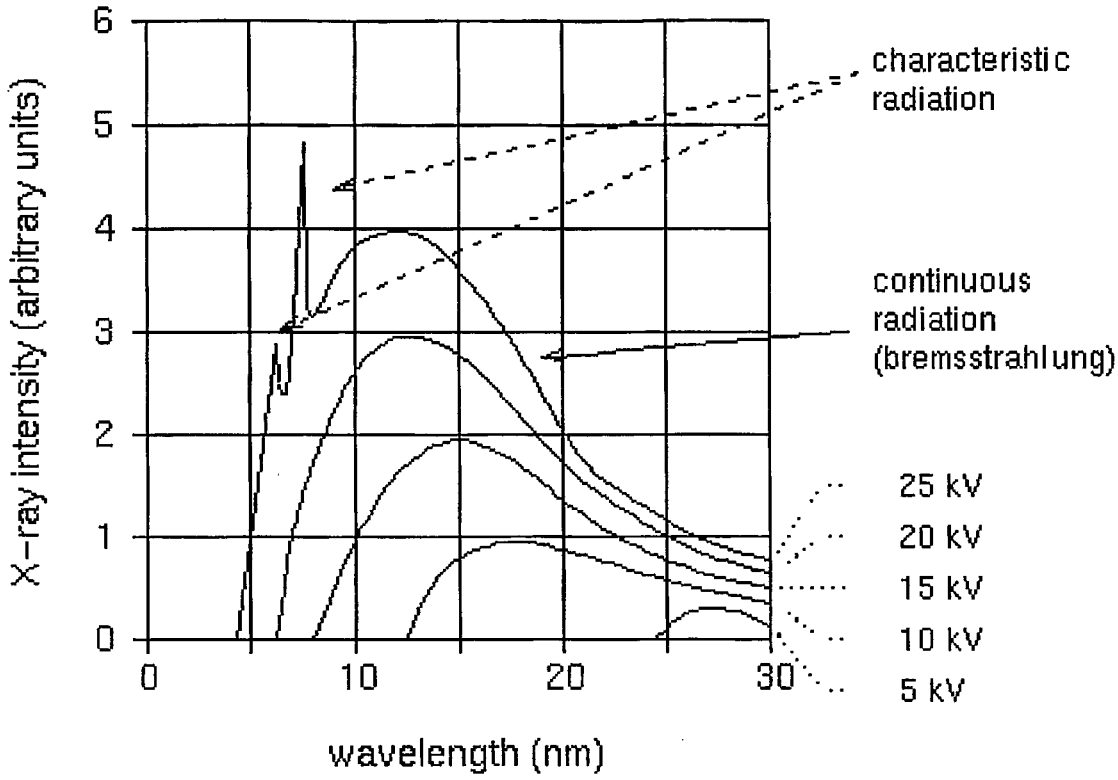
FIG. 3 is a graphical illustration of how bremsstrahlung radiation changes as the accelerating voltage of a conventional X-ray tube increases from 5 kV to 25 kV.

Another example of a use is in general radiographic applications for medical imaging. For example X-ray tubes for medical imaging use e-beam energies of about 23–28 kV for mammography, 60 kV for dental and orthopedic imaging applications, about 130 kV for chest imaging applications and about 80–85 kV for abdomen and GI X-rays. As the energy is increased, the spectrum of the brem radiation changes dramatically. FIG. 3 illustrates how the output flux varies with increasing accelerating voltages from 5 to 25 kV. FIG. 4 shows the output of a molybdenum target 25 μm thick with varying e-beam energies of 30, 40, 50 and 60 kV. This target is made using only a thin sheet of molybdenum without using a substrate. The energy spectrum of the output X-rays does not change appreciably even though the e-beam energies are doubled. FIGS. 5, 16, 17 and 18 are other examples of X-ray spectrum where the peak energy of the X-ray spectrum does not shift with increasing voltage. By using a single target with a number of different foils, substantially monochromatic X-rays can be produced which are considerably brighter; can be focused to smaller spot sizes providing better resolution of medical images; provide less radiation dosage to patients because of significantly reduced x-ray flux at lower X-ray energies; and allow for a single tube to be used for a host of different medical imaging applications. Aside from providing a low cost, high resolution tube for general radiography, such a tube allows for the addition of special functions to a general radiographic X-ray tube. Special functions include but are not limited to mammography, bone densitometry, angiography, "dual energy" chest, breast, and other imaging applications, and others with the same X-ray tube used for general radiography applications. Similar application can be found in imaging for non-destructive testing of various objects including electronic circuits among many others.

For dual energy applications a first image is taken with the e-beam focused onto one region of the target containing a desired foil, the e-beam is then focused onto another region of the target having a different desired foil and a second image is acquired. A third image can also be taken using a third region of the target having a third foil. The images are subtracted partially or totally to remove features not desired and leave those desired remaining. A transmission tube using the current target can improve current dual energy images which are hampered by inadequate photons in each image, energy separation between the X-rays producing each of the images, and image noise. It is possible to adjust the intensity of each of the images separately by changing not only the location that the e-beam impinges the target, but also by changing the energy of the e-beam impinging on a single foil or increasing the output flux without changing the energy of the peak flux output of the resulting X-ray spectrum from that foil.

Figure 2:
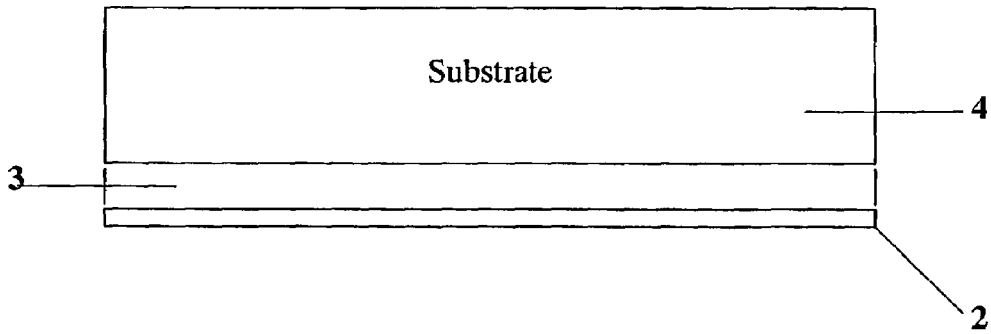
FIG. 2 is a graphical representation of the side view of a target constructed of two layered foils on a substrate.

In another embodiment of the invention an X-ray target has multiple different thin foils layered onto a substrate substantially transparent to X-rays. Alternatively, if the thickness and strength of the foil furthest from the cathode is sufficiently strong to seal the vacuum within the tube from ambient air, a substrate is not necessary. For example a thin layer of yttrium can be deposited on a 25 lm thick layer of molybdenum. The target can be employed in an X-ray transmission tube where the energy of the impinging e-beam is changed to provide X-rays of different substantially characteristic line energies, which are, at least in part, determined by the target materials, the thickness of the foil, and further determined by the energy of the impinging electron beam. FIG. 2 shows a side view of a target where the second layered material is a very thin foil 2 layered on top of a thicker foil 3 which has been layered on top of a substrate 4. Although for illustration purposes a substrate has been shown, substrates are not required in all applications. Although the picture shows only two layers, additional layers may be added depending on the application. When the energy of the impinging beam is below the absorption edge for the characteristic line energy of all of the foils, there is no generation of line energy emissions. There is an e-beam energy wherein only one of the multiple layered foils is producing characteristic X-rays. There is similarly a higher energy e-beam wherein all foil layers are producing characteristic line X-rays.

Figure 13:
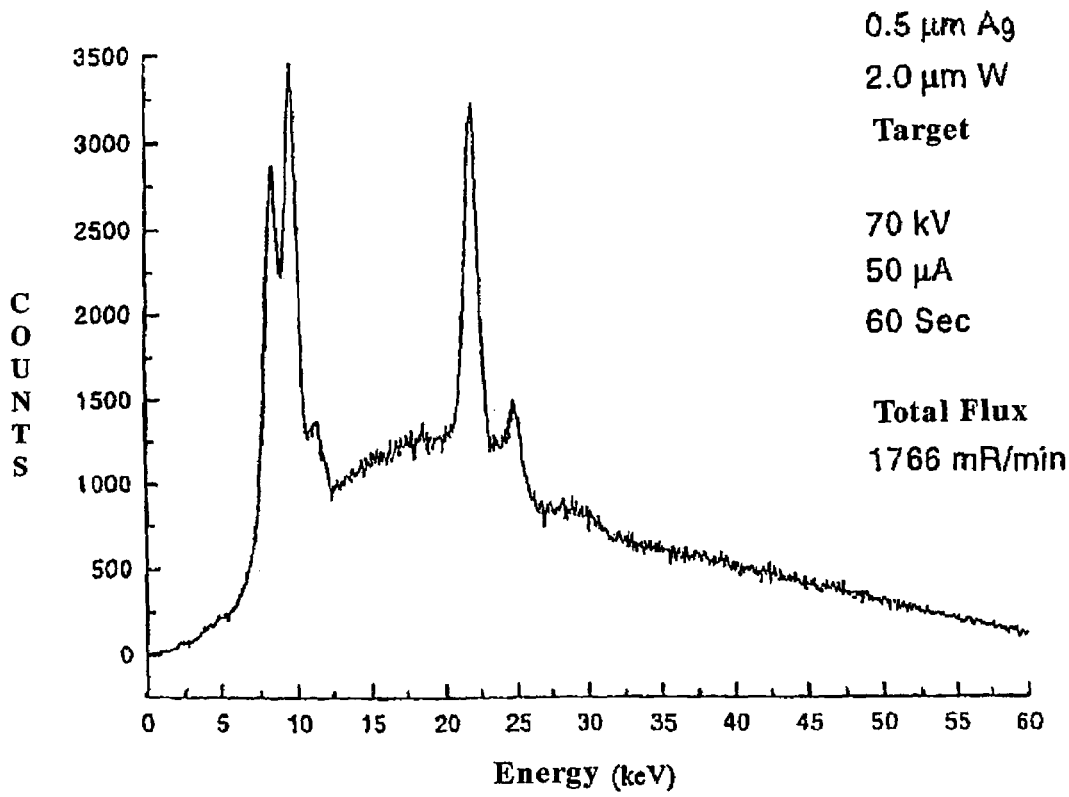
FIG. 13 is a graphical illustration of the intensity of the output flux as a function of output flux energy from a tube configured with a target made of layers of silver and tungsten.

If more than one set of line emissions is desired from the same X-ray focal spot, for example Yttrium (Y-k↦ of 14.9 keV) and Molybdenum (Mo k↦ of 17.4 keV) then a thin Y film of 0.4 μm coated on a 10 μm Mo foil on Be or Al substrate, would provide the Y k↦ line for an e-beam energy at 20 kV and both the Y and Mo line emissions at an e-beam energy of 60 kV. Both the same K alpha lines of Y and Mo would be emitted from the same X-ray focal spot when the e-beam energy is 60 kV. FIG. 13 shows a plot of X-ray flux intensity as a function of output x-ray energy from an X-ray tube with a layered target of this invention. A layer of 2.0 lm (micrometer) of tungsten is deposed onto a beryllium substrate. A second layer of 0.5 lm (micrometer) of silver is layered on top of the tungsten layer. With an energy of 70 kV impinging on the target the intensity of X-ray flux produced is plotted as a function of output X-ray energy. The peak shown at about 8.4 keV represents the characteristic L lines of tungsten and that of about 22 keV the K lines of silver. An impinging electron beam energy of less than about 10 keV produces no characteristic X-rays. However, as the e-beam energy increases, the characteristic L lines of Tungsten emerge. When the energy is raised above about 31 keV, both the L lines of Tungsten and the K lines of silver are present. X-ray images can be taken using only the L lines of Tungsten or using both the L lines of Tungsten and the K lines of Silver. This kind of target is thus very useful for dual energy imaging because it provides very high flux throughput from the higher energy K lines of silver and also very clear separation in energies between the K lines of silver and the L lines of Tungsten. Although for illustration purposes the K-lines of one material and the L-lines of another have been used, K-lines of both materials can be used equally as effectively.

The layered target of this invention is especially useful when a single X-ray tube is required to produce two images of an object with different energy spectrums and one image/ is subtracted from the other to eliminate unwanted signal. Since it is not necessary to move the electron beam, both images are made from a spot in the identical position. Some examples are subtracting unwanted images of fatty tissue in a mammogram from images of potential cancer lesions, removing bone images from chest X-ray images, bone densitometry using standard dual photon absorptiometry techniques, dual energy angiography, and many other dual energy imaging applications known to those skilled in the art in both non-destructive testing and medical imaging. Other applications might be for X-ray imaging when features being examined by an X-ray imaging system contain two or more features with different absorption spectrums each of which is important to the examiner. This type of target is especially helpful in multiple energy imaging for non-destructive testing of electronic circuit boards and integrated circuits. In general radiographic imaging by adjusting the e-beam voltage the same tube can provide imaging for a number of different parts of the body such as including but not limited to orthopedic, chest, GI, and head imaging. Filters may optionally be used to reduce any unwanted low energy radiation.

The layered foils can be used to replace a single foil in a target which has multiple thin foils coated onto separate areas of a substantially planar substrate which is substantially transparent to X-rays. The layered foil section allows production of X-rays of multiple characteristic energies by changing the energy of the impinging e-beam while other sections can be of any other construction required by the application.

Figure 8:
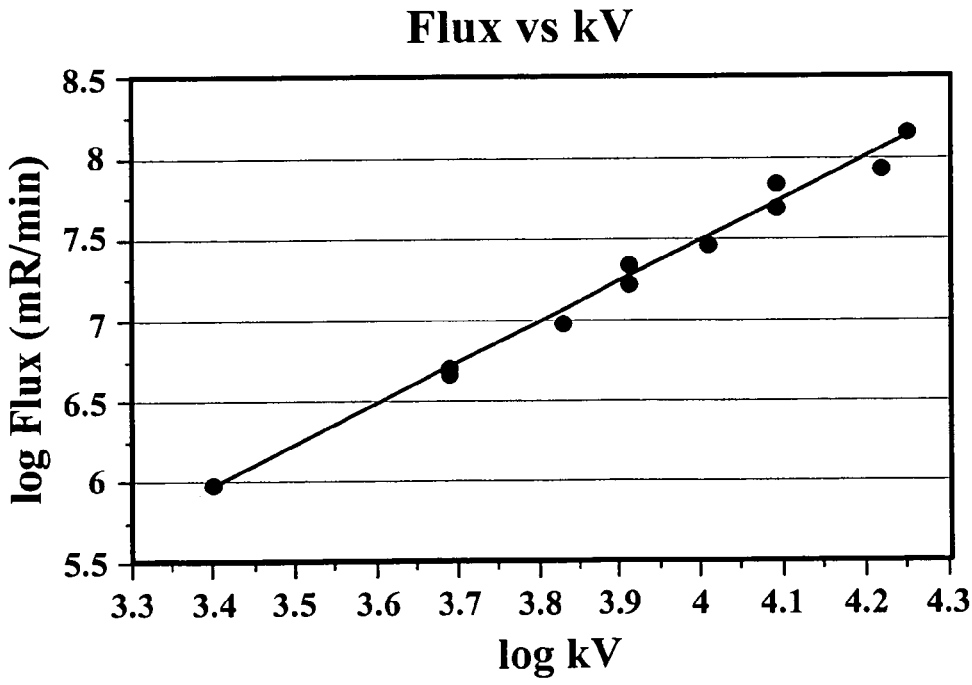
FIG. 8 is a graphical representation of the change in log of the output flux as a function of the log of the accelerating voltage of the e-beam.

In yet another embodiment of this invention an X-ray transmission tube is disclosed which utilizes e-bean energies significantly higher than those of the prior art. For conventional brem tubes, as the accelerating voltage of the electron beam is increased the percent of bremsstrahlung radiation in the forward direction of electron travel increases. However, the ratio of the total flux produced by two different accelerating voltages has traditionally been proportional to the ratio of accelerating voltages raised to the 1.7 power with most of the increased bremsstrahlung radiation dissipated in the target as heat. Conventional tubes not only lose much of the potential increase in flux, they generate excessive heat at the same time. For the tube of the present invention utilizing either a single target or multiple targets by selecting the proper foil thickness, the use of higher e-beam energies increases the output flux for line emissions proportional to the ratio of the e-beam energy voltages raised to about the 2.5 power. FIG. 5 represents actual measurements made of the current invention with a silver target thickness selected to provide substantially K-line characteristic x-rays of a preselected energy. FIG. 8 shows a plot of the log of the output Flux in mR/min versus the log in kV of the accelerating voltage of the tube with a slope of 2.5. Prior art teaches that e-beam energies should be about 50% above the K-absorption edge of the target element. For example molybdenum has a K-edge of 20 kV and produces k↦ radiation of 17.5 kV. Thus e-beam energies would be chosen at about 30 kV with the maximum thickness of the target of 2.0 μm. Target thickness must be increased to accommodate the increased energy of the impinging e-beam. At the same time the spectrum of output energy from a tube having a Mo target remains virtually the same operated at e-beam energies of 30 keV to 60 keV (see FIG. 4). By doubling the e-beam energy of the current invention from 30 keV to 60 keV, the output flux of the preselected X-ray energy can be increased by a factor of more than six times with no degradation of X-ray image because the energy spectrum of the output X-rays remains virtually unchanged (see FIG. 5).

A bright beam of X-rays is one in which the total number of X-ray photons per unit area reaching the subject to be imaged or the object to be radiated is high compared to the tube current producing those X-rays. Typical x-ray tubes in the market have a brightness of less than 20 mRem/mA measured at 60 cm from the focal spot. The tube of the current invention can provide brightness many times that. In one configuration of a tube using a molybdenum target 10 lm (micrometer) thick the tube produced a tube brightness of about 232 mRem/mA at 60 cm from the focal spot with an e-beam energy of 60 kV.

Figure 11:
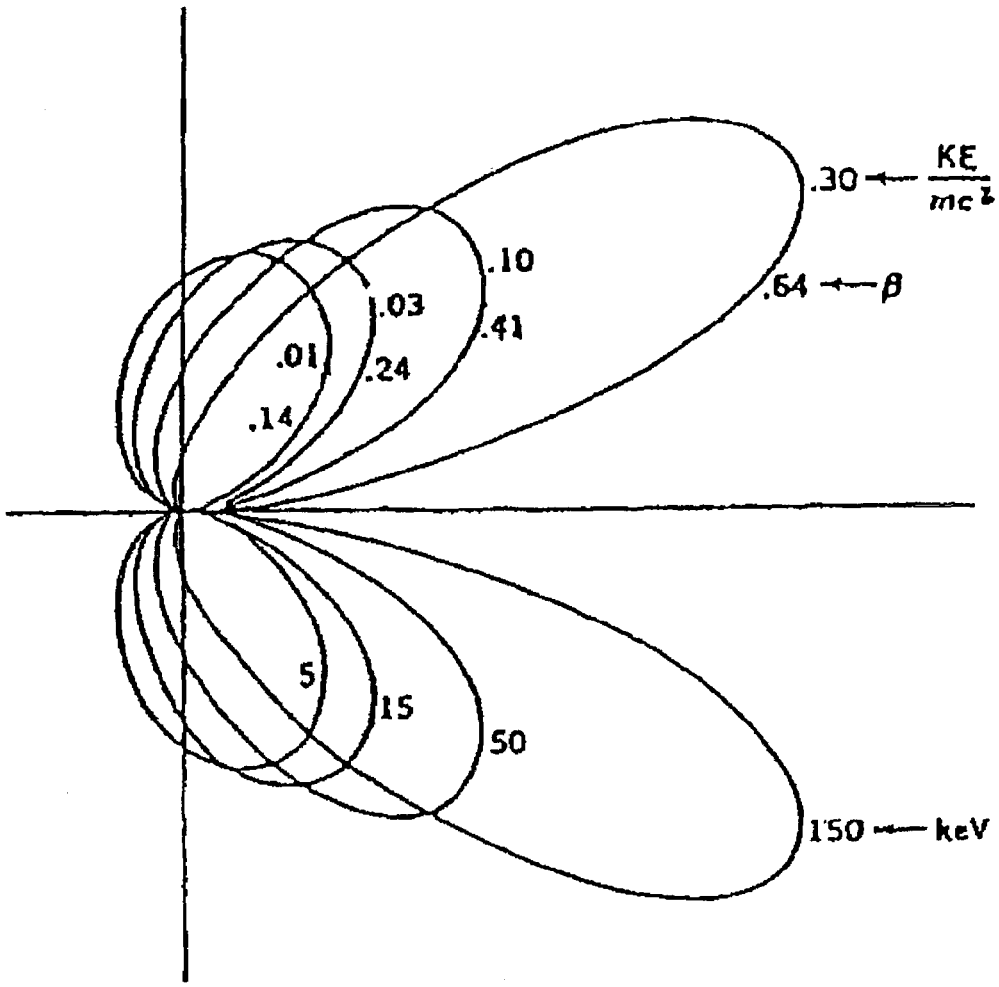
FIG. 11 is a diagrammatic representation of the direction of radiation of bremsstrahlung as a function of the energy of the decelerated electron.

Much of the increase in the output flux of the present invention is a result of the forward direction of bremsstrahlung radiation as the energy of the impinging electron is high enough that the velocity of the electron approaches the speed of light. FIG. 11 shows the radiation patterns of accelerated particles moving at various speeds. The curves are for electron energies of 5, 15, 50 and 150 keV. As the speed of the electron increases, the direction of bremsstrahlung radiation shifts to the forward direction because of relativistic effects. The transmission tube of the current invention takes advantage of this effect by efficiently utilizing the bremsstrahlung X-rays to produce useful characteristic X-rays deeper in the target which then are transmitted through the end-window. In a conventional tube with a thick metal target, this forward shift in flux distribution is absorbed by the target as heat.

In yet another embodiment of the present invention where bremsstrahlung radiation is more useful, the X-rays are used directly instead of converting them to characteristic X-rays, providing flux densities considerably higher than conventional X-ray tubes at the same tube currents and voltages.

When the energy of the impinging electrons is below the threshold energy required to produce X-rays of a predominantly single preselected energy, or when the thickness of the target foil is less than two times the electron penetration depth of the electrons striking the target, the resultant x-radiation is of a substantially broad bremsstrahlung radiation energy spectrum similar to state of the art medical imaging X-ray tubes today.

If the foil target thickness is too thin, most of the resultant radiation flux is concentrated more in the low X-ray energy range. Comparing FIGS. 14A and 14C and likewise FIGS. 14B and 14D, there is a noted shift in concentration of X-rays to the higher energy range with the thicker, 25 micron tungsten target compared to the 5 micron target thickness of the same tungsten. Lower energy X-rays in many applications are not useful and must be filtered out to avoid radiation poisoning of subjects. The thicker target of the current invention acts as a self filter, filtering out the lower energy X-rays which become absorbed by the thicker foil. Hence in some applications a target thickness of 25 microns is more useful than a target of 5 micron thickness, even through the flux density of the 5 micron target is considerably higher than that for the 25 micron target.

On the other hand the 5 micron thick target produces 8 to 14 times the amount of flux density compared to the 25 micron target. In some applications where lower energy X-rays are more useful than higher energy in producing an image (for example body extremities such as hands and feet), the target with a 5 micron thickness produces more useful X-rays, even after filtering, than the 25 micron target thickness. It becomes obivous that by selecting the proper thickness and desired output flux, any of a number of X-ray energy spectra can be produced.

As the accelerating voltage of the impinging electrons is raised above about 160 kV for both tungsten and platinum, the output spectrum gradually changes to predominantly characteristic K-line radiation. The K-lines for Tungsten are 59.3, 57.9 and 67.2 kV. As the accelerating voltages are increased to greater than 100% above these energies, the characteristic k-lines become gradually more prevalent and eventually become the predominant energy of the output X-rays when the accelerating energies are high enough. However, when the accelerating energies are below the threshold energy required to produce X-rays of a preselected energy, then a broad bremsstrahlung spectrum is generated.

In another embodiment of the invention when the tube voltage is increased to many times the k-alpha energy for the target material, depending on the kind of foil used for the target and its thickness, the ratio of the peak k-alpha flux to the peak brem flux begins to decrease with increasing tube voltage. The thickness of the foil target becomes less than two times the electron penetration depth of the electrons striking the target and hence predominantly bremsstrahlung radiation occurs. FIGS. 16E through H show that the k-alpha radiation does not increase appreciably, but the brem radiation does. It is another important feature of current invention that the peak energy of the brem radiation stays relatively stable or about 22 kV as shown in FIGS. 16D through 16H. This stability in flux with continuing increase in tube voltage is particularly attractive to increase the flux of the brem radiation without the traditional shift in energy to higher brem energies with increasing electron beam energies as can be seen in FIG. 3. As the voltage increased from 80 kV in FIG. 16E to 110 kV in FIG. 16H the increase in output flux was proportional to the ratio of the voltages raised to about the 1.6 or 1.7 power. Increasing the tube voltage allows for increased flux with significantly less target heating than by increasing only the tube current without a significant shift in the peak brem radiation to higher energies. This feature of the current invention is especially useful in imaging of electronic circuit boards including but not limited to circuits produced using Ball Grid Arrays.

FIG. 5 illustrates how increasing electron energies for a tube of the current invention with a single target produce strong characteristic x-radiation from a silver foil target with a thickness of 25 lm (micrometer). The preselected or k↦ characteristic X-ray emission lines for silver are at 22 kV. When the acceleration voltage of the electrons are greater than 100% above 22 kV or 44 kV, as can be seen in FIGS. 5C and 5D, the ratio of peak flux density of the k↦ characteristic x-rays to the bremsstrahlung X-rays is approximately 5:1 in FIG. 5C and 8:1 in FIG. 5D. When target foils are used, which produce characteristic k↦ X-rays in the lower energy range, such as Titanium (4.5 kV), Chromium (5.4 kV), Manganese (5.9 kV), Cobalt (6.9 kV), Nickel (7.5 kV), Copper (8 kV), or as high as Silver (22 kV) as show in FIG. 17, target thicknesses can be made as thick as 50 lm (micrometer) and accelerating voltages for the electrons can be 20 or higher times the k↦ energies (160 kV is a common accelerating voltage). FIG. 16 represents data taken from an X-ray tube with a 25 lm (micrometer) thick nickel target utilizing no substrate. The k↦ energy for nickel is 7.477 keV. FIG. 16 shows the output spectrum when an accelerating electron voltage of 110 kV is used. This is approximately 15 times the k↦ energy for nickel, but as is known by those skilled in the art energies of 150 kV would provide a similar output spectrum with a voltage more than 20 times the k↦ energy for nickel. FIG. 17 is data taken from an X-ray tube with a 41 lm (micrometer) thick silver target. Comparing this to FIG. 5 which uses a silver foil of 25 microns, the 41 lm (micrometer) target provides a higher percentage of k↦ radiation. Although 41 lm (micrometer) of target thickness was used to prepare this data, clearly 50 lm (micrometer) of target thickness could have been used as is well known by anyone skilled in the art resulting in slightly lower X-ray flux measurements and even more filtering of any brem radiation.

Figure 9:
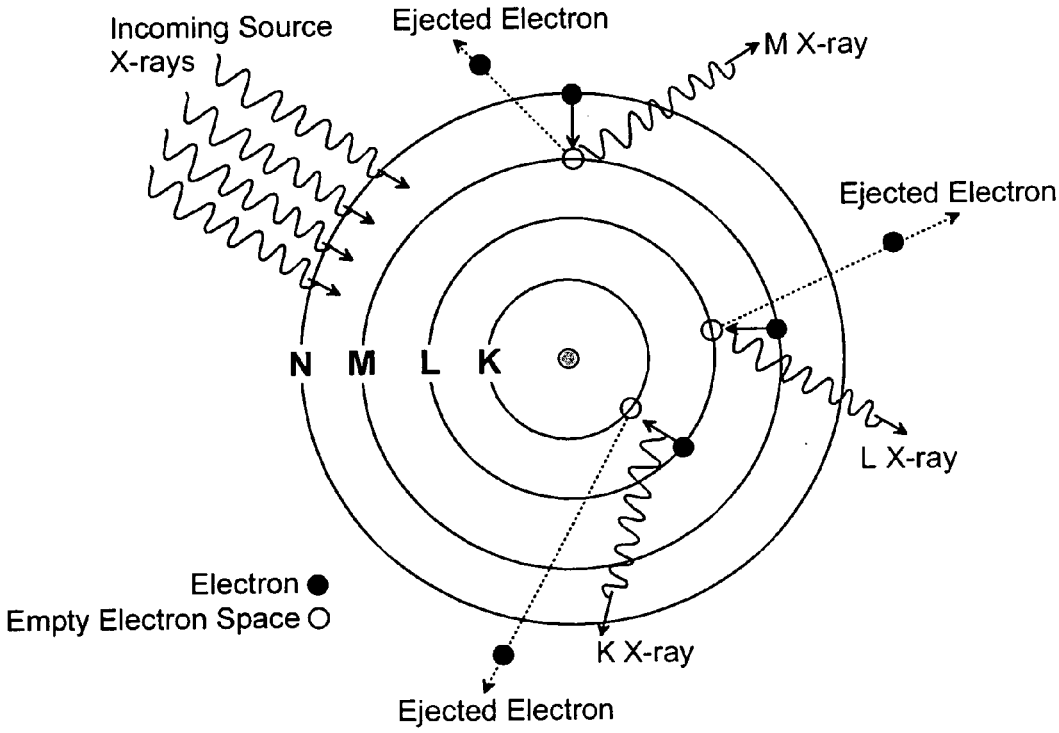
FIG. 9 is a graphical illustration of how X-ray radiation causes line emissions when it interacts with atoms of the target material.

In FIG. 6 the thickness of the target indicates the kind of radiation that can be expected. Although graphically the boundary between the region that produces brem radiation and characteristic radiation is a sharp line, in fact there is some line emission generated in a very thin film as well as brem radiation produced in a thicker thin film target. As electrons enter the target they are generally stopped within the first few lcrons of target material. The electrons can be stopped either by Coulomb scattering with nuclei of the atoms of the target material or by displacing an orbital electron creating characteristic X-rays. Although there are some characteristic X-rays generated by the impinging electrons, most of the electrons produce bremsstrahlung X-rays. These brem X-rays travel in the forward direction (direction of the impinging electrons) and displace orbital electrons from atoms deeper inside the target material as shown in FIG. 9. Because the mean free path of these x-rays is large most of the brem X-rays are converted to characteristic X-rays by this scattering mechanism. Thus as shown in FIG. 6, most of the brem radiation is generated when the electrons first enter the target. When applications do not require X-rays of substantially a preselected energy, by adjusting the thickness of the target and the energy of impinging electrons, brem radiation can be produced providing a low cost, highly efficient X-ray source for many applications.

Figure 12:
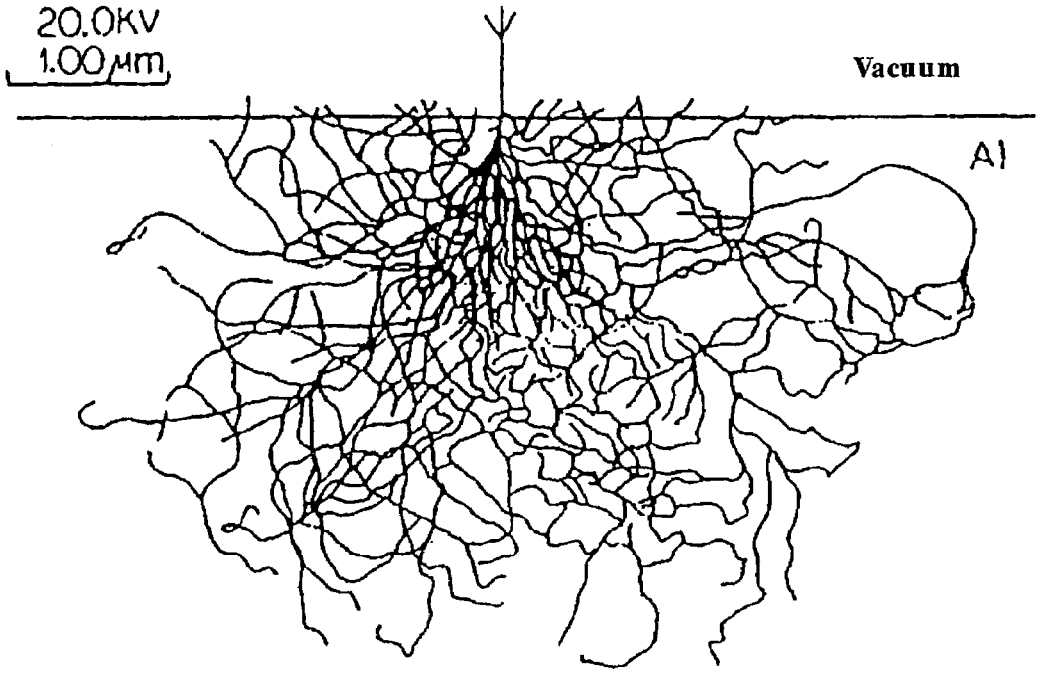
FIG. 12 is a diagrammatic representation of a Monte Carlo simulation of the scattering of electrons which impinge an aluminum target with energies of 20 kV.

FIG. 12 shows a Monte Carlo simulation of how electrons of an energy of 20 kV are scattered when they enter a target. Although there are multiple scattering of electrons in the target the bremsstrahlung x-radiation is generated mostly within the initial scattering. Most of these brem X-rays are subsequently converted to characteristic X-rays, depending on the thickness of the target material. As the brem radiation moves through the target material it generates K, L and M line radiation. FIG. 9 shows the mechanism by which the K, L and M line radiation is generated. The brem radiation interacts with shell electrons (usually the K and L shells) causing those electrons to be ejected. Electrons from the next energy level fill the empty electron space in the inner shell at a lower energy, emitting characteristic X-rays as they fill the empty electron space.

Another important feature of the current invention is that, while the e-beam is mostly stopped within the first few lms of the thickness of target film, the remaining target film thickness serves as a filter that absorbs very efficiently the brem photons with an energy above the characteristic absorption-edges of the target element and re-emits photons as fluorescent line-emissions with high yield. As the filter function is combined with the target, the line-emissions from a transmission target are therefore, highly enhanced, and are generated from the same X-ray focal spot on the target. Thus in imaging applications low energy, harmful X-ray photons are effectively filtered by the target, eliminating the need for additional filtering and subsequent filter "blur" in most applications.

A transmission tube configured for use in mammography with e-beam energies of 60 kV and a target of 10 μm thick molybdenum foil deposited on a beryllium substrate provides approximately 5 times greater efficiency per Watt of e-beam power compared to current mammography tubes. By doubling the accelerating voltage of the e-beam to 120 kV, the output flux can be increased by an additional factor of about 6 times. Combining these results, approximately less than 5% of the power through the tube of the current invention will produce X-ray fluxes equivalent to conventional mammography tubes. This power reduction reduces the weight and size of the tube and power supply as well as manufacturing costs of X-ray generation equipment housing the current invention. In addition it reduces the heat load on the target allowing for reduced spot sizes of the impinging e-beam with resultant improvements in image resolution. The flux of the tube is proportional to the tube current. The heat dissipated on the anode target is proportional to the tube current and e-beam voltage. Doubling the e-beam voltage with the current invention provides about a 6-fold increase in characteristic line flux, whereas doubling the current provides only a 2-fold increase. Thus, increasing the accelerating voltage of the e-beam according to the current invention will more efficiently increase the output flux than increasing the current.

Further, FIG. 12 shows a Monte Carlo simulation of electrons with energies of 20 kV impinging a target material of aluminum. The simulation shows that electrons are scattered many times as they enter the target. Each time an electron is scattered, it imparts energy in the form of heat to the target material. Since there is significant scatter in the lateral direction, heat is dissipated not only in the direction of the impinging e-beam but it is spread in a lateral direction as well. The higher the impinging electron energy the greater the lateral spread as well as the greater the penetration as shown in FIG. 10. It has been disclosed in U.S. Pat. No. 5,627,871, for very thin targets of less than about 2.0 μm, that the temperature rise due to impinging electrons is calculated assuming the isothermal contour in the target is a hemisphere with an area of 2○r (r being the spot size). Black body radiation, the energy of X-rays produced, and Auger emissions is ignored. At the heart of that calculation is the assumption that all of the energy of the impinging e-beam is dissipated very close to the surface of the X-ray target within the focal spot. In the present invention rather than heat being generated by impinging electrons very close to the surface of the X-ray target within the focal spot, there is a significantly larger volume over which the electrons lose their energy with higher e-beam energies. Thus the temperature rise of the target material per watt of impinging electron energy is considerably less for a higher energy e-beam, further facilitating the critical problems of target overheating.

The thickness of the film is chosen depending on the foil material, the desired type of X-ray emission, either line emission, brem or a combination of these, the desired tube brightness, and the accelerating voltage of the electron beam. To determine the thickness needed for the foil target, e-beam energies are experimentally increased to many fold the preselected X-ray energy and the resultant X-ray spectrum and the output flux measured. FIG. 16 demonstrates the change in flux spectrum as the voltage in increased to many time the k-alpha energy of Nickel. Thicker target material will provide a longer tube life at the cost of reduced transparency, and hence a trade-off between tube life and brightness is struck and the target thickness determined. Target thickness is generally less than about 50 μm and greater than about 2 μm, but with especially high-energy e-beams, target thickness can be even greater than 50 μm, as indicated by the e-beam penetration depth in FIG. 10. When the accelerating voltages are increased to many fold the k-alpha energy for any target thickness, as shown in FIG. 16, eventually the ratio of peak energy of k-alpha to bremsstrahlung radiation starts to decrease. Hence targets of 50 lm (micrometer) thickness can also be used to produce strong bremsstrahlung radiation. When the energy of the impinging electrons is below the threshold energy to produce k-alpha x-radiation, the thickness of the target can be as thin as 2 microns and as thick as 25 microns as shown in FIGS. 14C and D, and FIG. 13.

Figure 7:
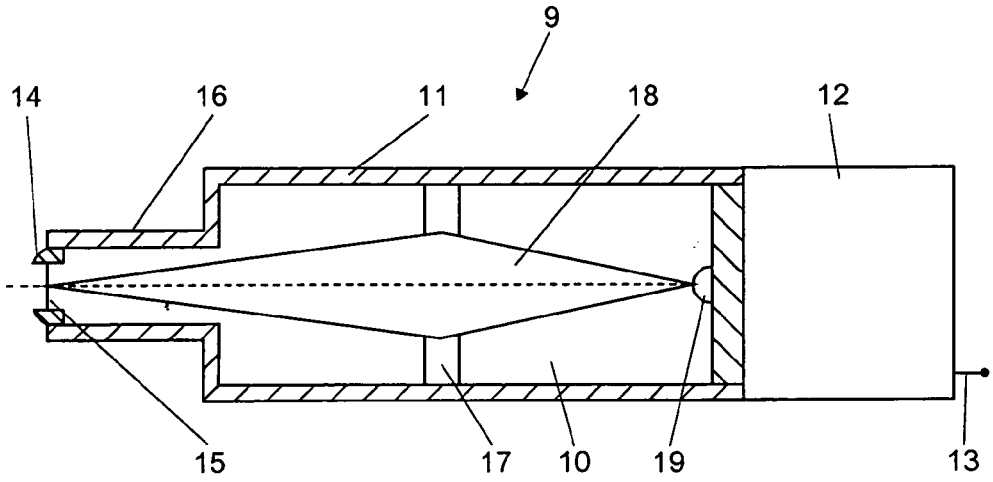
FIG. 7 is a schematic, elevational cross-sectional view of an X-ray tube of the invention.

In the transmission x-ray tube of the present invention an e-beam is produced and the design is such that the beam impinges an end-window and generates an X-ray flux. An X-ray tube according to the present invention is illustrated in FIG. 7. The x-ray tube 9 comprises an evacuated chamber 10 enclosed by an envelope. One end of the chamber 10 is connected to a high voltage power supply 12 which is connected by line 13 to controlling electronics for the high voltage power supply (not shown).

Contained in chamber 10 is a cathode e-beam emitter 19 connected to the said high voltage power supply 12. The e-beam emitter may be made of a number of different filament materials and configurations familiar to those skilled in the art.

End Window 14 has on its inside surface a foil target 15 onto which the electron beam impinges. The end window may be mounted in a tubular extension 16 of smaller diameter than ceramic envelope 11 Tubular extension 16 may be ceramic or metal, is usually stainless steel and, being open to the interior of chamber 10, is evacuated. A typical outside diameter of tubular extension 16 is ⅝ inch. Tubular extension 16 may be surrounded by an annular magnetic coil or lens (not shown). Within chamber 10 is at least one electrostatic lens 17 which focuses e-beam 18.

Contained in chamber 10 is e-beam emitter 19 connected to said power supply 12. The e-beam emitter 19 may comprise a whisker such as a whisker of a tungsten filament. The whisker may have a diameter of several microns and a chemically etched tip of submicron size, from which e-beam 19 is generated. The e-beam spot focused on the target is of similar size as the whisker tip. The e-beam is focused by electrostatic focusing lens 17. Further focusing may be accomplished by the above-mentioned magnetic lens.

Chamber 10, and tubular extension 16 if used, is evacuated by evacuating means such as a vacuum pump; it may be baked at about 305° C. for 9 to 12 hours to de-gas ceramic and metal parts, and then is sealed.

The foil target is typically attached to a substrate window made of low Z elements and which is substantially transparent to at least some of the x-rays produced. The substrate window conducts the current and heat, transmits x-ray flux, and seals the vacuum. However, when the target material is sufficiently thick and hard and is not porous, there is no need for a substrate and the target material itself provides a barrier so that ambient air does not enter the evacuated chamber. As with foils deposited on a substrate, the free standing foils can be any electrically conducting material which can produce x-rays. Although such foils are usually made of a metal or an alloy or a metal, there are conducting polymers which can likewise contain elements which are also capable of producing x-rays according to the current invention. Some target materials, which provide the kind of mechanical characteristics, include but are not limited to molybdenum, copper, nickel, tungsten, platinum, aluminum, gadolinium, gold, lanthanum, silver, thulium, yttrium, and alloys thereof. Conducting polymers can also provide foil targets which do not require a substrate. When a substrate is used heat can be removed easily from the side of the substrate interfacing to ambient air. This is another major advantage of the current invention over tubes using either a rotating anode or a fixed solid anode. Substrate materials of beryllium and aluminum offer rapid heat transfer. When a substrate is not used the heat can be removed within about 50 microns, the target thickness, of the spot where electrons impinge on the target and generate heat. Forced air cooling, liquid cooling and cooling by other means well known to those skilled in the art further allows for reduction in the cost of manufacturing the x-ray tube.

The end window comprises the tube anode. The end window may be mounted in an extension to the envelope 11. The power supply 12 may be adjusted by use of an integral or external controller. Adjustments include but are not limited to the voltage applied from the cathode to the anode, the duration of the time the e-beam is striking the target, the size of the spot size of the e-beam impinging the target, the area of the target where the e-beam strikes, and the current flowing through the tube. Feedback from measurements made of the output flux or of the image being taken with the X-ray tube may be used for automatic control as well.

In one embodiment the beam of electrons may be focused by a focusing mechanism. The focal spot may be located onto different regions of the target. One possible focusing mechanism is an electrostatic lens 17. The electrostatic lens may be optionally at the electrical potential of the filament producing electrons or at a voltage negative to said filament voltage. The power supply 12 comprises transformers and circuit elements for supplying current to an emitter 19, for establishing an accelerating voltage on electron beam traveling from the emitter (cathode) to impinge the end-window target (anode), for optionally supplying voltage to the mechanism which focuses the e-beam, and for optionally supplying current to the mechanism which moves the focal spot as might be required, as well as other functions required in the operation of the tube. In other embodiments the electrostatic lens may not be required. At least some of the components of the power supply 12 may be contained in a housing, which may be filled with insulating oil, gel or epoxy.

Flux density measurements presented herein have been produced with an electrostatic lens which was not optimized to provide the highest possible output flux. More recent lens designs have increased the output flux by at least four to five times those initial measurements. It is anticipated that with subsequent improvements in focusing mechanisms further improvements in flux will be realized.

In one embodiment magnetic focusing is provided by a ring magnet. Magnetic focusing may be accomplished by devices such as a Suzuki Pre-condenser Objective Lens, a doublet quadropole lens, triple quadropole lens or permanent magnets by those skilled in the art. The electrostatic lens 17 and optional magnetic focusing devices may be used in combination or separately and may be adjusted by any number of methods known by those skilled in the art to provide different focal spot sizes on the target material. Focal spot sizes include but are not limited to spot sizes from nanometers to millimeters depending on the needs of thermal management, etc.

An important aspect of all kinds of imaging with X-rays is that the relative absorption between two different materials within the object to be imaged of X-rays is different for X-rays of different energies. For example the soft tissue of the lung has a very different absorption spectrum from that of bone tissue. Bone tissue absorbs a high percentage of the X-rays used in medical imaging. Soft tissue on the other hand is invisible to high energy X-rays. When looking at an X-ray film or the image from a digital X-ray sensor, the bone appears white, meaning that most of the X-ray flux is absorbed by the bone and does not reach the film. That for soft tissue appears dark for higher energy X-rays because there is very little absorption of high energy X-rays by soft tissue. Differential absorption within two different materials being imaged provides the contrast by which two the materials can be differentiated visually. For different kinds of soft tissue there is a specific energy at which the maximum absorption difference between the tissues can be realized. In medical imaging, using X-rays containing only that energy is ideal. Lower energies are absorbed in the patient as harmful radiation and higher energies cause blackening of the X-ray detector. Using substantially characteristic X-rays from a tube of the current invention and selecting the proper target material, the X-ray energy may be selected to provide the maximum contrast with few X-rays being produced not needed for imaging. Thus not only does the tube provide significantly higher flux for the same tube wattage, the energy of the flux may be selected so that less overall tube flux is needed to provide the same image contrast. This advantage is applicable to all kinds of imaging.

The high efficiency, small spot size, low power requirements, reduction of dosage for patients because low energy X-rays are greatly reduced, increased resolution, light weight small size tube and power supply, and general low cost of production of these tubes make them particularly appealing for a number of applications including but not limited to general radiographic medical imaging, fluoroscopic medical imaging, cardiovascular imaging, mammography, angiography, dental imaging, non destructive evaluation of luggage and shipping containers, electronic circuit board imaging, integrated circuit imaging, computed tomography, bone densitometry, and radiation therapy. The light weight and high X-ray flux output make them particularly advantageous as the X-ray source in C-arms and portable X-ray equipment. In C-arm applications the X-ray source and image receptor are mounted on opposing ends to face each other along an X-ray beam axis. The C-arm can be rotated about the subject to obtain images from a number of different incident angles to the subject. Because the X-ray source is supported wholly by the mechanical C-arm structure and must be physically moved about the subject, the light weight of the transmission tube and power supply of this invention provides considerable cost advantages to alternative tubes. Portable X-ray equipment require the X-ray source to be capable of rolling ambulation or hand carry by at least one human operator during transportation and selective stabilization for patient or animal scanning. The light weight, lower cost and significantly higher output flux of the current transmission tube will increase the use of portable X-ray equipment for imaging applications which have not been accessible because of the constraints of current X-ray tubes.

This transmission tube may be combined with either the target containing multiple thin foils coated on separate areas of a substantially planar substrate or with layered foils on the same target and as such incorporates all advantages and uses of those targets as well.

The high photon flux output of the current tube and/or the ability to produce X-rays of preselected energies make this tube especially cost effective in applications which expose a biological sample to said X-ray flux to destroy or significantly alter all or a portion of the biological sample with the ionizing radiation of the X-ray beam, with secondary fluorescent X-rays or with emitted Auger electrons generated by said X-ray flux.

The focal spot may be selectively moved to different locations on the same target. Some applications include moving the impinging e-beam from one foil material to another on the same target. Other applications use movement of the beam to different locations on the same foil to decrease the thermal load at the focal spot or to increase the service life of the X-ray transmission tube when the thin foil has become damaged during use. Examples of such techniques for moving the impinging e-beam spot include, but are not limited to, techniques for the movement of the electron beam in television tubes and scanning electron microscopes and are well know to those skilled in the art.

The transmission target can be fixed or part of a mechanical rotating disc in order to spread the e-beam thermal load. Liquid and heat pipe cooling of the target can be used to dissipate target heat build-up.

In another preferred embodiment, the shape and design of the electron emitting filament can be made in a way well know to those skilled in the art to provide limited focusing of the electron beam onto the target. There are many non-imaging applications where electron focusing is not required. Examples include but are not limited to sterilization and non-destructive fluoroscopic analysis.

Metal foils for the targets and X-ray transmission tubes of this invention can be made of a single metal element or a combination of a metal with some other element to include but not be limited to alloys, ceramics, polymers and composites. Included are metals conventionally used as target materials. For example, the metals may be selected from Ag, Mo, Y, Rh, Au, La, Tm and others. Substrate materials can be but are not limited to beryllium, aluminum, and alloys of these metals. Alternately, a very thin foil of a high Z target, such as W, Pt, or Au, about 0.5 μm thick can be layered on top of another target foil not currently considered to be an appropriate target material such as La or Tm. The high Z target produces mostly brem radiation, which then excites line emission from the underlying target.

The invention claimed is:

1. An end window x-ray tube comprising:

an evacuated housing that is sealed;

an end window anode disposed in said housing comprised of a target comprising a thin foil or a plurality of thin foils;

a cathode disposed in said housing which emits an electron beam, which proceeds along a beam path in said housing to strike said anode in a spot, generating a beam of x-rays which exits the housing through the end window;

a power supply connected to said cathode providing a selected electron beam energy to produce a bright beam of x-rays of at least one preselected energy characteristic of the target foil or foils; wherein the electron beam energy is higher than two times and as high as 20 times the preselected energy of the k-line x-rays characteristic of the target foil or foils; and wherein the thickness of the target foil or foils is chosen to produce a bright source of generated x-rays, said thickness being at least 2.1 μm.

2. An end window x-ray tube according to claim 1, wherein the thickness of the target is between 2.1–41 μm.

3. An end-window x-ray tube according to claim 1, where the foil is deposited on a substrate material substantially transparent to x-rays.

4. An end window x-ray tube according to claim 3, wherein the substrate material comprises beryllium, aluminum, an alloy of beryllium or an alloy of aluminum.

5. An end-window x-ray tube according to claim 1, wherein the e-beam is focused above, below or onto the target by a focusing lens.

6. A method for x-ray fluoroscopy comprising (a) providing the end window x-ray tube according to claim 5, and (b) causing said x-ray tube to produce said bright source generated x-rays for use in x-ray fluoroscopy.

7. A method for obtaining dental images comprising (a) providing the end window x-ray tube according to claim 5, and (b) causing said x-ray tube to produce x-rays to obtain said dental images.

8. An end window x-ray tube according to claim 5, wherein said target comprises: two or more different thin foils or at least two foils of the same material but different foil thickness on separate areas of a substantially planar substrate which is substantially transparent to x-rays; wherein each different foil being different from the other foil emits different x-rays whose characteristics are determined at least in part by the characteristics of the foils upon impingement of a foil by a single electron beam, wherein each different thickness of the same material emits different x-rays whose characteristics are determined at least in part by the thickness of the foils upon impingement by a single electron beam, and wherein the electron beam, the target or both can be moved so that the electron beam selectively impinges on one of said different foils or different foil thickness of the same material.

9. A method for obtaining medical images comprising (a) providing the end window x-ray tube according to claim 5, and (b) causing said x-ray tube to produce said bright source of generated x-rays to obtain said medical images.

10. A method for obtaining images of integrated circuits comprising (a) providing the end window x-ray tube according to claim 5, and (b) causing said x-ray tube to produce said bright source of generated x-rays to obtain the images of said integrated circuits.

11. A method for producing images by computer tomography comprising (a) providing the end window x-ray tube according to claim 5, and (b) causing said x-ray tube to produce said bright source of generated x-rays that are used in producing images by computer tomography.

12. An apparatus comprising the end window x-ray tube according to claim 5, and a C-arm having an x-ray source and image receptor at opposing ends to face each other along an x-ray beam axis.

13. A method for patient or animal imaging comprising (a) providing a portable x-ray source capable of rolling ambulation or hand carry with the end window x-ray tube according to claim 5 and (b) moving said portable x-ray source and causing said x-ray tube to produce x-rays to obtain said patient or animal imaging.

14. An end window x-ray tube comprising:

an evacuated housing that is sealed;

an end window anode disposed in said housing comprised of a target of a thin foil or a plurality of thin foils;

a cathode disposed in said housing which emits an electron beam, which proceeds along a beam path in said housing to strike said anode in a spot, generating a beam of x-rays which exits the housing through the end window; wherein said electron beam is focused above, below or onto the target by a focusing lens;

a power supply connected to said cathode providing a selected electron beam energy to produce a bright beam of x-rays characteristic of the target foil or foils; and wherein the thickness of the target foil or foils is less than two times the electron penetration depth of the electrons striking the target producing predominantly bremsstrahlung x-rays.

15. An end window x-ray tube according to claim 14, wherein the thickness of the target foil or foils is from 2 to 50 microns.

16. An end window tube of claim 14, wherein said target comprises:

two or more different thin foils or at least two foils of the same material but different foil thickness on separate areas of a substantially planar substrate which is substantially transparent to x-rays; the thickness of at least one of said foils is less than two times of the electron penetration depth of the electrons impinging said foil producing predominantly bremsstrahlung x-rays; wherein each different foil being different from the other foil emits different x-rays whose characteristics are determined at least in part by the characteristics of the foils upon impingement of a foil by a single electron beam, and wherein each different thickness of the same material emits different x-rays whose characteristics are determined at least in part by the thickness of the foils upon impingement by a single electron beam, and wherein the electron beam, the target or both can be moved so that the electron beam selectively impinges on one of said different foils or different foil thickness of the same material.

17. A method for obtaining medical images comprising (a) providing the end window x-ray tube according to claim 14, and (b) causing said x-ray tube to produce the predominately bremsstrahlung x-rays to obtain said medical images.

18. A method for x-ray fluoroscopy comprising (a) providing the end window x-ray tube according to claim 14, and (b) causing said x-ray tube to produce the predominately bremsstrahlung x-rays for use in x-ray fluoroscopy.

19. An apparatus comprising the end window x-ray tube according to claim 14, and a C-arm having an x-ray source and image receptor at opposing ends to face each other along an x-ray beam axis.

20. A method for medical imaging comprising (a) providing the end window x-ray tube according to claim 14, and (b) causing said x-ray tube to produce x-rays for medical imaging.

21. A method for obtaining images of electronic circuit boards comprising (a) providing the end window x-ray tube according to claim 14, and (b) causing said x-ray tube to produce x-rays to obtain images of said electronic circuit boards.

22. A method for obtaining images of integrated circuits comprising (a) providing the end window x-ray tube according to claim 14, and (b) causing said x-ray tube to produce x-rays to obtain the images of said integrated circuits.

23. A method for patient or animal imaging comprising (a) providing a portable x-ray source capable of rolling ambulation or hand carry with the end window x-ray tube according to claim 14 and (b) moving said portable x-ray source and causing said x-ray tube to produce x-rays to obtain said patient or animal imaging.

24. A method for obtaining dental images comprising (a) providing the end window x-ray tube according to claim 14, and (b) causing said x-ray tube to produce x-rays to obtain said dental images.

25. An x-ray transmission tube comprising:

(a) a sealed, evacuated housing, (b) an end-window anode disposed in said housing comprising a target of at least two different foils layered sequentially one on the other, each of the different foils comprising a different material;

(c) a cathode disposed in said housing emits an electron beam; wherein x-rays are produced when an electron beam impinges the foil closest to the source of the electron beam; wherein the energy spectrum of said x-rays is determined at least in part by the energy of the electron beam impinging on the target material; and (d) power supply means connected to said cathode for enabling the electron beam to be produced with either (i) a first preselected energy whereby to cause only the first foil to emit a characteristic emission with said line emission being characteristic of the first foil or (ii) a second preselected energy whereby to cause each of the first and second foils to produce a line emission with the line emission of the first foil being characteristic of the first foil and the line emission of the second foil being characteristic of the second foil.

26. A method for producing an image of an object comprising:

(a) providing the x-ray tube of claim 25; and (b) taking a first image of the object using the x-ray transmission tube with the electron beam at the first preselected energy; then taking a second image of the object using the x-ray transmission tube with the electron beam at the second preselected energy or vice versa.

27. The method according to claim 26, further comprising (c) subtracting, at least partially, the first image from the second image or vice versa to produce a resultant image wherein an unwanted signal of the first or second image is removed.

* * * * *